US007017585B2

(12) United States Patent
Li et al.

(10) Patent No.: US 7,017,585 B2
(45) **Date of Patent: *Mar. 28, 2006**

(54) OXIDANT/CATALYST NANOPARTICLES TO REDUCE TOBACCO SMOKE CONSTITUENTS SUCH AS CARBON MONOXIDE

(75) Inventors: Ping Li, Chesterfield, VA (US); Mohammad Hajaligol, Midlothian, VA (US)

(73) Assignee: Philip Morris USA Inc., Richmod, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/286,968

(22) Filed: Nov. 4, 2002

(65) Prior Publication Data

US 2003/0131859 A1 Jul. 17, 2003

Related U.S. Application Data

(63) Continuation-in-part of application No. 09/942,881, filed on Aug. 31, 2001.

(51) Int. Cl.
*A24B 15/18* (2006.01)

(52) U.S. Cl. ..... 131/334; 131/364

(58) Field of Classification Search ..... 131/364, 131/360, 352, 347, 334
See application file for complete search history.

(56) References Cited

U.S. PATENT DOCUMENTS

| | | | | |
|---|---|---|---|---|
| 3,472,237 | A | 10/1969 | Stephens | |
| 3,621,851 | A * | 11/1971 | Heskett et al. | 131/339 |
| 3,720,214 | A | 3/1973 | Norman et al. | |
| 3,796,793 | A * | 3/1974 | Metzer | 423/263 |
| 3,807,416 | A | 4/1974 | Hedge et al. | |
| 3,931,824 | A | 1/1976 | Miano et al. | |
| 4,109,663 | A | 8/1978 | Maeda et al. | |
| 4,119,104 | A | 10/1978 | Roth | |
| 4,193,412 | A | 3/1980 | Heim et al. | |
| 4,195,645 | A | 4/1980 | Bradley, Jr. et al. | |
| 4,197,861 | A | 4/1980 | Keith | |
| 4,317,460 | A | 3/1982 | Dale et al. | |
| 4,397,321 | A * | 8/1983 | Stuetz | 131/334 |
| 4,574,821 | A | 3/1986 | Fischer et al. | |
| 4,956,330 | A | 9/1990 | Elliott et al. | |
| 5,050,621 | A | 9/1991 | Creighton et al. | |
| 5,101,839 | A | 4/1992 | Jakob et al. | |
| 5,105,836 | A | 4/1992 | Gentry et al. | |
| 5,129,408 | A | 7/1992 | Jakob et al. | |
| 5,258,330 | A | 11/1993 | Khandros et al. | |
| 5,258,340 | A | 11/1993 | Augustine et al. | |
| 5,322,075 | A | 6/1994 | Deevi et al. | |
| 5,443,560 | A | 8/1995 | Deevi et al. | |
| 5,446,003 | A | 8/1995 | Augustine et al. | |
| 5,591,368 | A | 1/1997 | Fleischhauer et al. | |
| 5,598,868 | A | 2/1997 | Jakob et al. | |
| 5,934,289 | A | 8/1999 | Watkins et al. | |
| 6,053,176 | A | 4/2000 | Adams et al. | |
| 6,095,152 | A | 8/2000 | Beven et al. | |

FOREIGN PATENT DOCUMENTS

| | | |
|---|---|---|
| CH | 609217 | 2/1979 |
| EP | 0031700 | 7/1981 |
| GB | 685822 | 1/1953 |
| GB | 863287 | 3/1961 |
| GB | 973854 | 10/1964 |
| GB | 1104993 | 3/1968 |
| GB | 1315374 | 5/1973 |
| WO | 87/06104 | 10/1987 |
| WO | 00/40104 | 7/2000 |

OTHER PUBLICATIONS

James E. Brady et al, "Fundamentals of Chemistry, 2nd Ed.", John Wiley & Sons, 1961, pp. 409-411.*

(Continued)

*Primary Examiner*—Dionne A. Walls
(74) *Attorney, Agent, or Firm*—Buchanan Ingersoll PC

(57) ABSTRACT

Cut filler compositions, cigarettes, methods for making cigarettes and methods for smoking cigarettes are provided, which involve the use of nanoparticle additives capable of reducing at least one constituent from mainstream and/or sidestream tobacco smoke, the at least one constituent being selected from the group consisting of aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, benzo(a)pyrene, and mixtures thereof. Preferably, the nanoparticle additives are effective as an oxidant for the conversion of carbon monoxide to carbon dioxide and/or as a catalyst for the conversion of carbon monoxide to carbon dioxide and/or catalyst for conversion of aldehydes such as acetaldehyde and acrolein, hydrocarbons such as isoprene and/or phenolic compounds such as catechol to carbon dioxide and water vapor. Methods for making a cigarette are provided, which involve (i) adding a nanoparticle additive to a cut filler; (ii) providing the cut filler comprising the additive to a cigarette making machine to form a tobacco rod; and (iii) placing a paper wrapper around the tobacco rod to form the cigarette. Further, methods of smoking the cigarette described above are described, which involve lighting the cigarette to form smoke and drawing the smoke through the cigarette, wherein during the smoking of the cigarette, the additive is capable of reducing at least one constituent from mainstream and/or sidestream tobacco smoke.

29 Claims, 20 Drawing Sheets

OTHER PUBLICATIONS

Written Opinion for PCT/US02/27407 dated Sep. 3, 2003.
Notification of Transmittal of the International Search Report dated Oct. 29, 2002 for PCT/US02/27407.
Notification of Transmittal of International Preliminary Examination Report for PCT/US03/34879 dated Feb. 17, 2005.
Written Opinion for PCT/US03/34879 dated Aug. 9, 2004.
Notification of Transmittal of International Preliminary Examination Report for PCT/US02/27407 dated Aug. 2, 2004.

* cited by examiner

OXIDANT/CATALYST NANOPARTICLES TO REDUCE TOBACCO SMOKE CONSTITUENTS SUCH AS CARBON MONOXIDE

This application is a continuation-in-part of application Ser. No. 09/942,881, filed on Aug. 31, 2001, the entire contents of which are hereby incorporated by reference.

FIELD OF INVENTION

The invention relates generally to methods for reducing constituents such as carbon monoxide in the mainstream smoke of a cigarette during smoking. More specifically, the invention relates to cut filler compositions, cigarettes, methods for making cigarettes and methods for smoking cigarettes, which involve the use of nanoparticle additives capable of acting as an oxidant for the conversion of carbon monoxide to carbon dioxide and/or as a catalyst for the conversion of carbon monoxide to carbon dioxide and/or catalyst for the conversion of hydrocarbons such as isoprene and/or aldehydes such as acetaldehyde and acrolein and/or phenolic compounds such as catechol to carbon dioxide and water.

BACKGROUND

Various methods for reducing the amount of carbon monoxide in the mainstream smoke of a cigarette during smoking have been proposed. For example, British Patent No. 863,287 describes methods for treating tobacco prior to the manufacture of tobacco articles, such that incomplete combustion products are removed or modified during smoking of the tobacco article. This is said to be accomplished by adding a calcium oxide or a calcium oxide precursor to the tobacco. Iron oxide is also mentioned as an additive to the tobacco.

Cigarettes comprising absorbents, generally in a filter tip, have been suggested for physically absorbing some of the carbon monoxide, but such methods are usually not completely efficient. A cigarette filter for removing unwanted byproducts formed during smoking is described in U.S. Re. Pat. No. RE 31,700, where the cigarette filter comprises dry and active green algae, optionally with an inorganic porous adsorbent such as iron oxide. Other filtering materials and filters for removing unwanted gaseous byproducts, such as hydrogen cyanide and hydrogen sulfide, are described in British Patent No. 973,854. These filtering materials and filters contain absorbent granules of a gas-adsorbent material, impregnated with finely divided oxides of both iron and zinc. In another example, an additive for smoking tobacco products and their filter elements, which comprises an intimate mixture of at least two highly dispersed metal oxides or metal oxyhydrates, is described in U.S. Pat. No. 4,193,412. Such an additive is said to have a synergistically increased absorption capacity for toxic substances in the tobacco smoke. British Patent No. 685,822 describes a filtering agent that is said to oxidize carbon monoxide in tobacco smoke to carbonic acid gas. This filtering agent contains, for example, manganese dioxide and cupric oxide, and slaked lime. The addition of ferric oxide in small amounts is said to improve the efficiency of the product.

The addition of an oxidizing reagent or catalyst to the filter has been described as a strategy for reducing the concentration of carbon monoxide reaching the smoker. The disadvantages of such an approach, using a conventional catalyst, include the large quantities of oxidant that often need to be incorporated into the filter to achieve considerable reduction of carbon monoxide. Moreover, if the ineffectiveness of the heterogeneous reaction is taken into account, the amount of the oxidant required would be even larger. For example, U.S. Pat. No. 4,317,460 describes supported catalysts for use in smoking product filters for the low temperature oxidation of carbon monoxide to carbon dioxide. Such catalysts include mixtures of tin or tin compounds, for example, with other catalytic materials, on a microporous support. Another filter for smoking articles is described in Swiss patent 609,217, where the filter contains tetrapyrrole pigment containing a complexed iron (e.g. haemoglobin or chlorocruorin), and optionally a metal or a metal salt or oxide capable of fixing carbon monoxide or converting it to carbon dioxide. In another example, British Patent No. 1,104,993 relates to a tobacco smoke filter made from sorbent granules and thermoplastic resin. While activated carbon is the preferred material for the sorbent granules, it is said that metal oxides, such as iron oxide, may be used instead of, or in addition to the activated carbon. However, such catalysts suffer drawbacks because under normal conditions for smoking, catalysts are rapidly deactivated, for example, by various byproducts formed during smoking and/or by the heat. In addition, as a result of such localized catalytic activity, such filters often heat up during smoking to unacceptable temperatures.

Catalysts for the conversion of carbon monoxide to carbon dioxide are described, for example, in U.S. Pat. Nos. 4,956,330 and 5,258,330. A catalyst composition for the oxidation reaction of carbon monoxide and oxygen to carbon dioxide is described, for example, in U.S. Pat. No. 4,956,330. In addition, U.S. Pat. No. 5,050,621 describes a smoking article having a catalytic unit containing material for the oxidation of carbon monoxide to carbon dioxide. The catalyst material may be copper oxide and/or manganese dioxide. The method of making the catalyst is described in British Patent No. 1,315,374. Finally, U.S. Pat. No. 5,258,340 describes a mixed transition metal oxide catalyst for the oxidation of carbon monoxide to carbon dioxide. This catalyst is said to be useful for incorporation into smoking articles.

Metal oxides, such as iron oxide have also been incorporated into cigarettes for various purposes. For example, in WO 87/06104, the addition of small quantities of zinc oxide or ferric oxide to tobacco is described, for the purposes of reducing or eliminating the production of certain unwanted byproducts, such as nitrogen-carbon compounds, as well as removing the stale "after taste" associated with cigarettes. The iron oxide is provided in particulate form, such that under combustion conditions, the ferric oxide or zinc oxide present in minute quantities in particulate form is reduced to iron. The iron is claimed to dissociate water vapor into hydrogen and oxygen, and cause the preferential combustion of nitrogen with hydrogen, rather than with oxygen and carbon, thereby preferentially forming ammonia rather than the unwanted nitrogen-carbon compounds.

In another example, U.S. Pat. No. 3,807,416 describes a smoking material comprising reconstituted tobacco and zinc oxide powder. Further, U.S. Pat. No. 3,720,214 relates to a smoking article composition comprising tobacco and a catalytic agent consisting essentially of finely divided zinc oxide. This composition is described as causing a decrease in the amount of polycyclic aromatic compounds during smoking. Another approach to reducing the concentration of carbon monoxide is described in WO 00/40104, which describes combining tobacco with loess and optionally iron oxide compounds as additives. The oxide compounds of the constituents in loess, as well as the iron oxide additives are said to reduce the concentration of carbon monoxide.

Moreover, iron oxide has also been proposed for incorporation into tobacco articles, for a variety of other purposes. For example, iron oxide has been described as particulate inorganic filler (e.g. U.S. Pat. Nos. 4,197,861; 4,195,645; and 3,931,824), as a coloring agent (e.g. U.S. Pat. No. 4,119,104) and in powder form as a burn regulator (e.g. U.S. Pat. No. 4,109,663). In addition, several patents describe treating filler materials with powdered iron oxide to improve taste, color and/or appearance (e.g. U.S. Pat. Nos. 6,095,152; 5,598,868; 5,129,408; 5,105,836 and 5,101,839). However, the prior attempts to make cigarettes incorporating metal oxides, such as FeO or $Fe_2O_3$ have not led to the effective reduction of carbon monoxide in mainstream smoke.

Despite the developments to date, there remains a need for improved and more efficient methods and compositions for reducing the amount of carbon monoxide in the mainstream smoke of a cigarette during smoking. Preferably, such methods and compositions should not involve expensive or time consuming manufacturing and/or processing steps. More preferably, it should be possible to catalyze or oxidize carbon monoxide not only in the filter region of the cigarette, but also along the entire length of the cigarette during smoking.

SUMMARY

The invention provides cut filler compositions, cigarettes, methods for making cigarettes and methods for smoking cigarettes which involve the use of nanoparticle additives capable of acting as an oxidant for the conversion of tobacco smoke constituents such as carbon monoxide to carbon dioxide and/or as a catalyst for the conversion of carbon monoxide to carbon dioxide and/or catalyst for the conversion of hydrocarbons such as isoprene and/or aldehydes such as acetaldehyde and acrolein and/or phenolic compounds such as catechol to carbon dioxide and water.

One embodiment of the invention relates to a cut filler composition comprising tobacco and at least one additive capable of acting as an oxidant for the conversion of carbon monoxide to carbon dioxide and/or as a catalyst for the conversion of carbon monoxide to carbon dioxide, where the additive is in the form of nanoparticles.

Another embodiment of the invention relates to a cigarette comprising a tobacco rod, wherein the tobacco rod comprises cut filler having at least one additive capable of acting as an oxidant for the conversion of carbon monoxide to carbon dioxide and/or as a catalyst for the conversion of carbon monoxide to carbon dioxide, wherein the additive is in the form of nanoparticles.

A further embodiment of the invention relates to a method of making a cigarette, comprising (i) adding an additive to a cut filler, wherein the additive is capable of acting as an oxidant for the conversion of carbon monoxide to carbon dioxide and/or as a catalyst for the conversion of carbon monoxide to carbon dioxide, wherein the additive is in the form of nanoparticles; (ii) providing the cut filler comprising the additive to a cigarette making machine to form a tobacco rod; and (iii) placing a paper wrapper around the tobacco rod to form the cigarette.

Yet another embodiment of the invention relates to a method of smoking the cigarette described above, which involves lighting the cigarette to form smoke and drawing the smoke through the cigarette, wherein during the smoking of the cigarette, the additive acts as an oxidant for the conversion of carbon monoxide to carbon dioxide and/or as a catalyst for the conversion of carbon monoxide to carbon dioxide.

In a preferred embodiment of the invention, the additive is capable of acting as both an oxidant for the conversion of carbon monoxide to carbon dioxide and as a catalyst for the conversion of carbon monoxide to carbon dioxide. The additive is preferably a metal oxide, such as $Fe_2O_3$, CuO, $TiO_2$, $CeO_2$, $Ce_2O_3$, or $Al_2O_3$, or a doped metal oxide such as $Y_2O_3$ doped with zirconium or $Mn_2O_3$ doped with palladium. Mixtures of additives may also be used. Preferably, the additive is present in an amount effective to convert at least 50% of the carbon monoxide to carbon dioxide. The additive has an average particle size preferably less than about 500 nm, more preferably less than about 100 nm, even more preferably less than about 50 nm, and most preferably less than about 5 nm. Preferably, the additive has a surface area from about 20 $m^2/g$ to about 400 $m^2/g$, or more preferably from about 200 $m^2/g$ to about 300 $m^2/g$.

The cigarettes produced according to the invention preferably have about 5 mg nanoparticle additive per cigarette to about 100 mg additive per cigarette, and more preferably from about 40 mg additive per cigarette to about 50 mg additive per cigarette.

In a preferred embodiment, the additive is capable of reducing at least one constituent from mainstream and/or sidestream tobacco smoke, the at least one constituent being selected from the group consisting of aldehyde, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, benzo(a)pyrene, and mixtures thereof. Preferably, the additive is effective for the conversion of carbon monoxide to carbon dioxide and/or catalyst for the conversion of hydrocarbon such as isoprene and/or aldehydes such as acetaldehyde and acrolein and/or phenolic compounds such as catechol to carbon dioxide and water.

BRIEF DESCRIPTION OF THE DRAWINGS

Preferred embodiments of the invention are discussed in the following detailed description, taken in conjunction with the accompanying drawings, in which.

DETAILED DESCRIPTION

Figure 1:
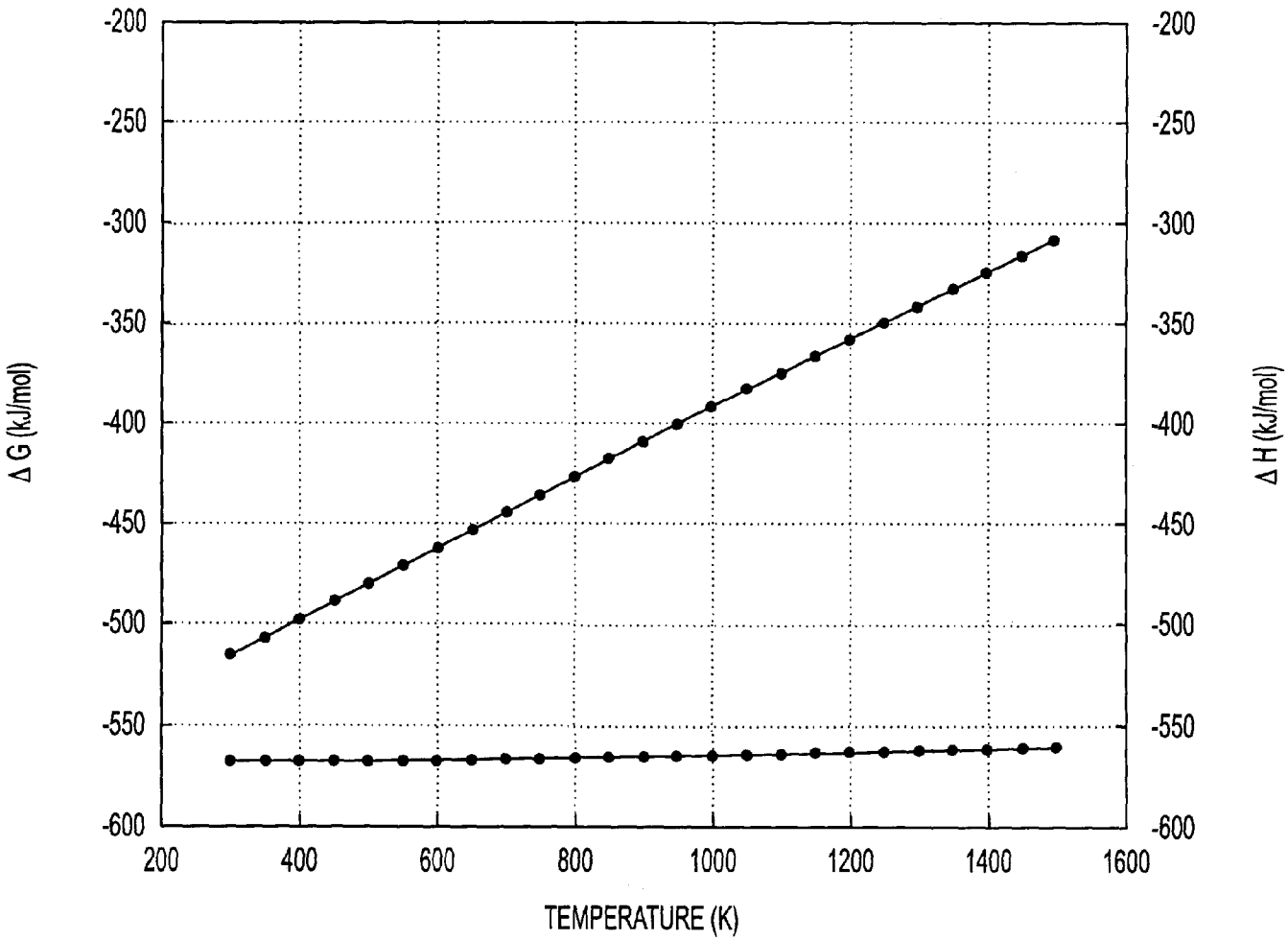
FIG. 1 depicts the temperature dependence of the Gibbs Free Energy and Enthalpy for the oxidation reaction of carbon monoxide to carbon dioxide.

The invention provides cut filler compositions, cigarettes, methods for making cigarettes and methods for smoking cigarettes which involve the use of nanoparticle additives capable of acting as an oxidant for the conversion of carbon monoxide to carbon dioxide and/or as a catalyst for the conversion of carbon monoxide to carbon dioxide. Through the invention, the amount of carbon monoxide in mainstream smoke can be reduced, thereby also reducing the amount of carbon monoxide reaching the smoker and/or given off as second-hand or sidestream smoke.

The term "mainstream" smoke refers to the mixture of gases passing down the tobacco rod and issuing through the filter end, i.e. the amount of smoke issuing or drawn from the mouth end of a cigarette during smoking of the cigarette. The mainstream smoke contains smoke that is drawn in through both the lighted region, as well as through the cigarette paper wrapper.

The total amount of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition starts at a temperature of about 180° C., and finishes at around 1050° C., and is largely controlled by chemical kinetics. Formation of carbon monoxide and carbon dioxide during combustion is controlled largely by the diffusion of oxygen to the surface ($k_a$) and the surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above. Besides the tobacco constituents, the temperature and the oxygen concentration are the two most significant factors affecting the formation and reaction of carbon monoxide and carbon dioxide.

While not wishing to be bound by theory, it is believed that the nanoparticle additives can target the various reactions that occur in different regions of the cigarette during smoking. During smoking there are three distinct regions in a cigarette: the combustion zone, the pyrolysis/distillation zone, and the condensation/filtration zone. First, the "combustion region" is the burning zone of the cigarette produced during smoking of the cigarette, usually at the lighted end of a cigarette. The temperature in the combustion zone ranges from about 700° C. to about 950° C., and the heating rate can go as high as 500° C./second. The concentration of oxygen is low in this region, since it is being consumed in the combustion of tobacco to produce carbon monoxide, carbon dioxide, water vapor, and various organics. This reaction is highly exothermic and the heat generated here is carried by gas to the pyrolysis/distillation zone. The low oxygen concentrations coupled with the high temperature leads to the reduction of carbon dioxide to carbon monoxide by the carbonized tobacco. In this region, the nanoparticle additive acts as an oxidant to convert carbon monoxide to carbon dioxide. As an oxidant, the nanoparticle additive oxidizes carbon monoxide in the absence of oxygen. The oxidation reaction begins at around 150° C., and reaches maximum activity at temperatures higher than about 460° C.

The "pyrolysis region" is the region behind the combustion region, where the temperatures range from about 200° C. to about 600° C. This is where most of the carbon monoxide is produced. The major reaction in this region is the pyrolysis (i.e. the thermal degradation) of the tobacco that produces carbon monoxide, carbon dioxide, smoke components, and charcoal using the heat generated in the combustion zone. There is some oxygen present in this zone, and thus the nanoparticle additive may act as a catalyst for the oxidation of carbon monoxide to carbon dioxide. As a catalyst, the nanoparticle additive catalyzes the oxidation of carbon monoxide by oxygen to produce carbon dioxide. The catalytic reaction begins at 150° C. and reaches maximum activity around 300° C. The nanoparticle additive preferably retains its oxidant capability after it has been used as a catalyst, so that it can also function as an oxidant in the combustion region as well.

Third, there is the condensation/filtration zone, where the temperature ranges from ambient to about 150° C. The major process is the condensation/filtration of the smoke components. Some amount of carbon monoxide and carbon dioxide diffuse out of the cigarette and some oxygen diffuses into the cigarette. However, in general, the oxygen level does not recover to the atmospheric level.

As mentioned above, the nanoparticle additives may function as an oxidant and/or as a catalyst, depending upon the reaction conditions. In a preferred embodiment of the invention, the additive is capable of acting as both an oxidant for the conversion of carbon monoxide to carbon dioxide and as a catalyst for the conversion of carbon monoxide to carbon dioxide. In such an embodiment, the catalyst will provide the greatest effect. It is also possible to use combinations of additives to obtain this effect.

By "nanoparticles" is meant that the particles have an average particle size of less than a micron. The additive preferably has an average particle size less than about 500 nm, more preferably less than about 100 nm, even more preferably less than about 50 nm, and most preferably less than about 5 nm. Preferably, the additive has a surface area from about 20 $m^2/g$ to about 400 $m^2/g$, or more preferably from about 200 $m^2/g$ to about 300 $m^2/g$.

The nanoparticles may be made using any suitable technique, or the nanoparticles can be purchased from a commercial supplier. For instance, MACH I, Inc., King of Prussia, Pa. sells $Fe_2O_3$ nanoparticles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/mL. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 nm and a surface area of about 40 $m^2/g$.

Preferably, the selection of an appropriate nanoparticle catalyst and/or oxidant will take into account such factors as stability and preservation of activity during storage conditions, low cost and abundance of supply. Preferably, the nanoparticle additive will be a benign material. Further, it is preferred that the nanoparticles do not react or form unwanted byproducts during smoking.

Figure 2:
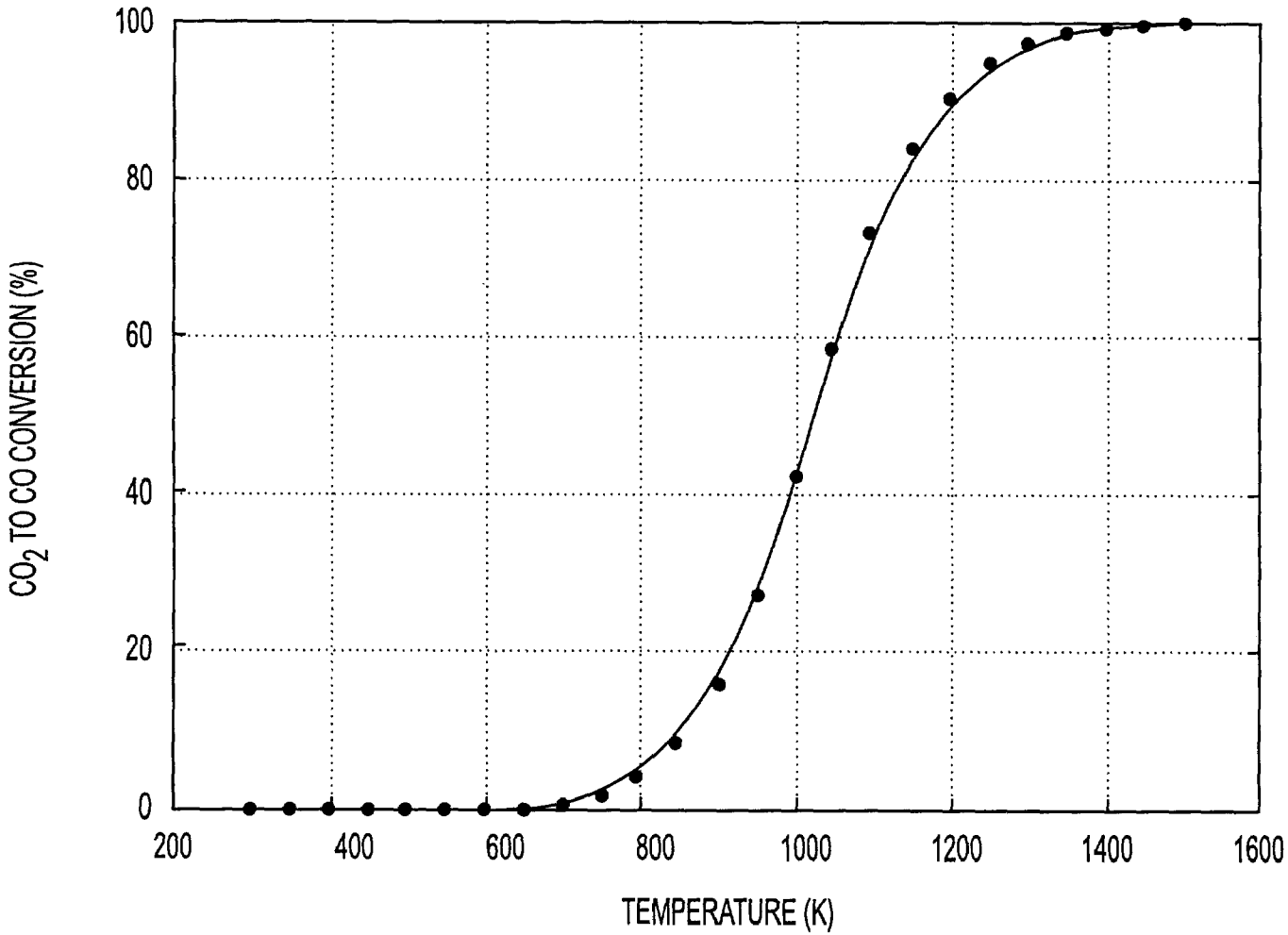
FIG. 2 depicts the temperature dependence of the percentage conversion of carbon dioxide to carbon monoxide by carbon to form carbon monoxide.

In selecting a nanoparticle additive, various thermodynamic considerations may be taken into account, to ensure that oxidation and/or catalysis will occur efficiently, as will be apparent to the skilled artisan. For example, FIG. 1 shows a thermodynamic analysis of the Gibbs Free Energy and Enthalpy temperature dependence for the oxidation of carbon monoxide to carbon dioxide. FIG. 2 shows the temperature dependence of the percentage of carbon dioxide conversion with carbon to form carbon monoxide.

In a preferred embodiment, metal oxide nanoparticles are used. Any suitable metal oxide in the form of nanoparticles may be used. Optionally, one or more metal oxides may also be used as mixtures or in combination, where the metal oxides may be different chemical entities or different forms of the same metal oxide.

Preferred nanoparticle additives include metal oxides, such as $Fe_2O_3$, CuO, $TiO_2$, $CeO_2$, $Ce_2O_3$, or $Al_2O_3$, or doped metal oxides such as $Y_2O_3$ doped with zirconium, $Mn_2O_3$ doped with palladium. Mixtures of additives may also be used. In particular, $Fe_2O_3$ is preferred because it is not known to produce any unwanted byproducts, and will simply be reduced to FeO or Fe after the reaction. Further, when $Fe_2O_3$ is used as the additive, it will not be converted to an environmentally hazardous material. Moreover, use of a precious metal can be avoided, as the $Fe_2O_3$ nanoparticles are economical and readily available. In particular, NANOCAT® Superfine Iron Oxide (SFIO) and NANOCAT® Magnetic Iron Oxide, described above, are preferred additives.

Figure 3:
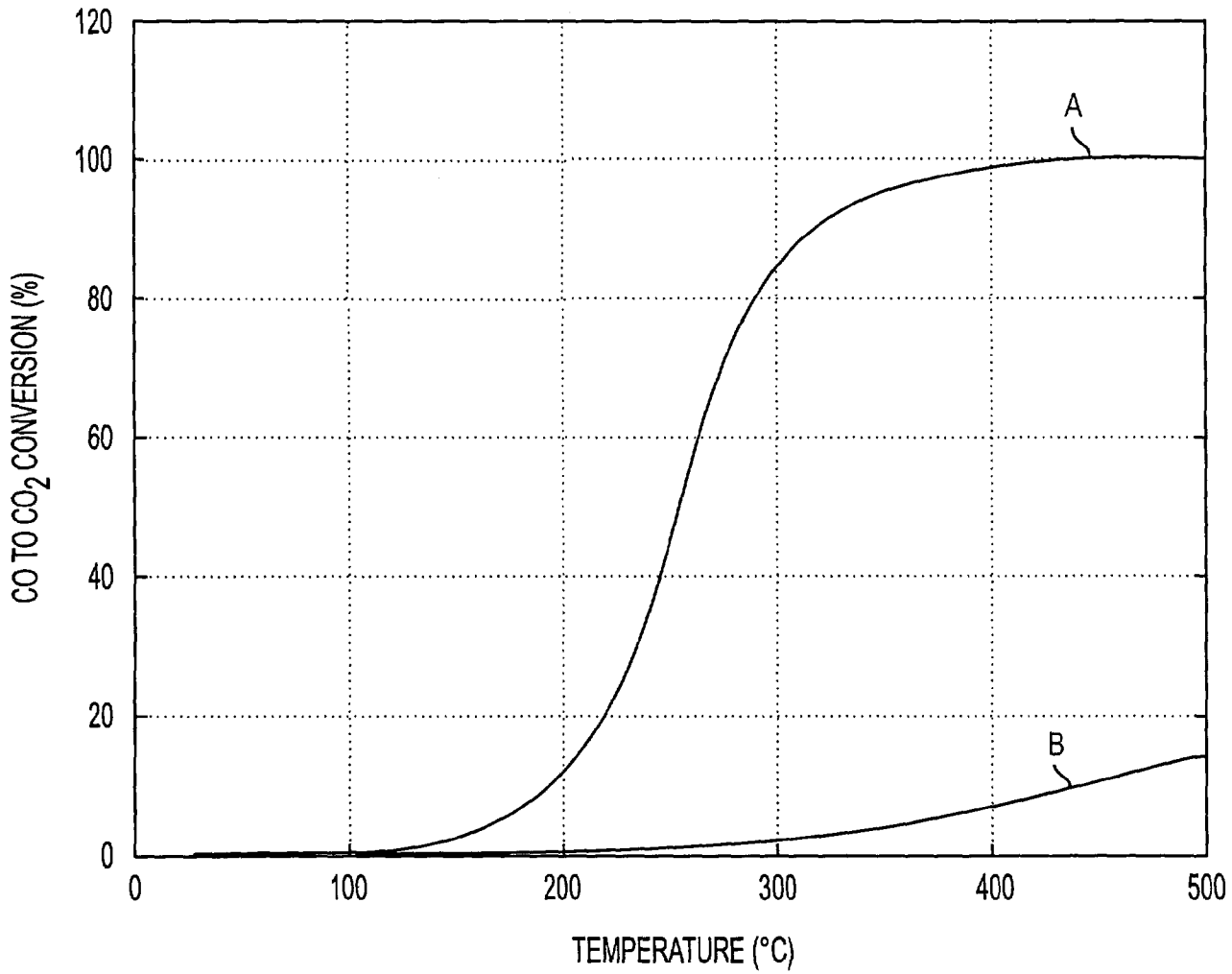
FIG. 3 depicts a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 μm.

FIG. 3 shows a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm (curve A), versus $Fe_2O_3$ powder (from Aldrich Chemical Company) having an average particle size of about 5 μm (curve B). The test conditions include flow rate of 1000 ml/min of He containing 20.6% $O_2$ and 3.4% Co, 50 mg catalyst and 12K/min heating rate. The $Fe_2O_3$ nanoparticles show a much higher percentage of conversion of carbon monoxide to carbon dioxide than the $Fe_2O_3$ having an average particle size of about 5 μm.

Figure 4A:
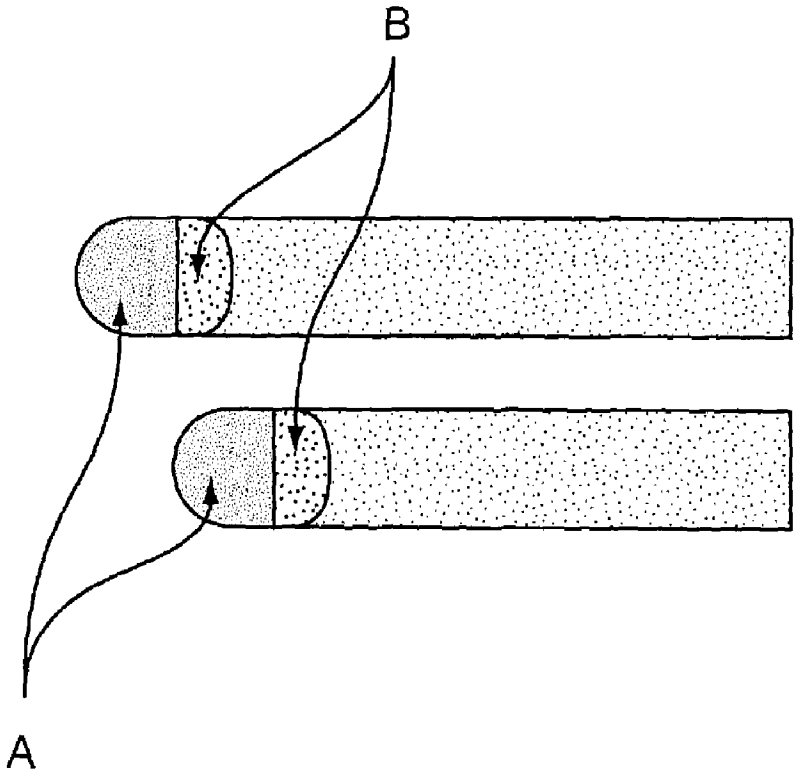
FIGS. 4A and 4B depict the pyrolysis region (where the $Fe_2O_3$ nanoparticles act as a catalyst) and the combustion zone (where the $Fe_2O_3$ nanoparticles act as an oxidant) in a cigarette.
Figure 4B:
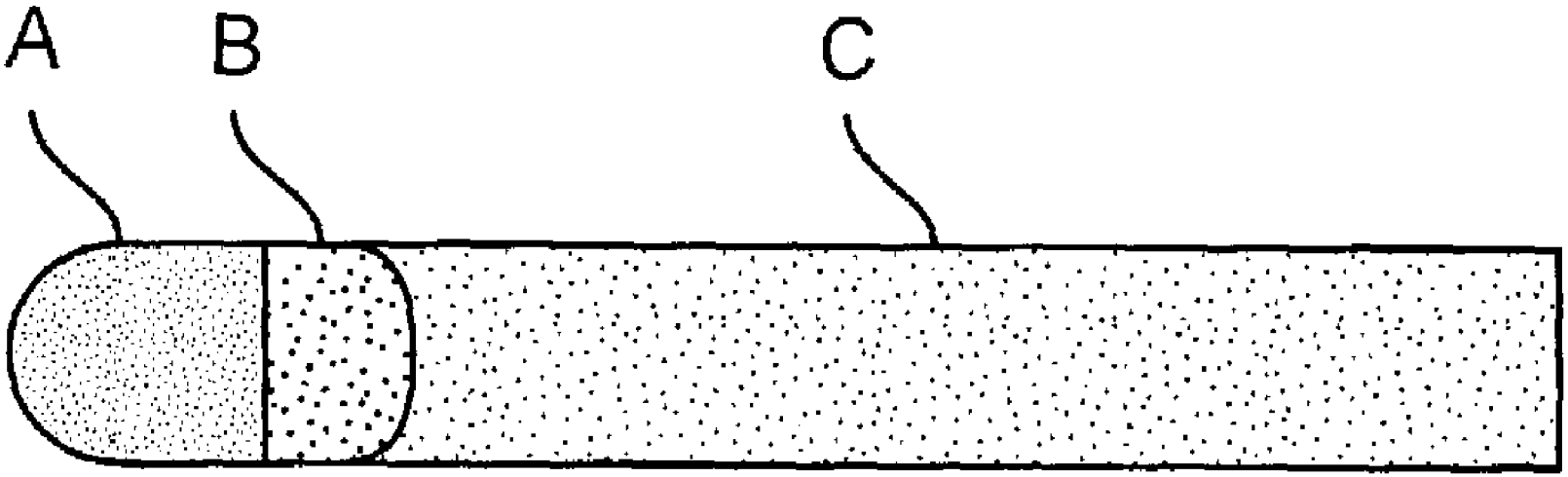

$Fe_2O_3$ nanoparticles are capable of acting as both an oxidant for the conversion of carbon monoxide to carbon dioxide and as a catalyst for the conversion of carbon monoxide to carbon dioxide. As shown schematically in FIG. 4A, the $Fe_2O_3$ nanoparticles act as a catalyst in the pyrolysis zone A wherein $2CO+O_2 \rightarrow 2CO_2$, and act as an oxidant in the combustion region B wherein $Fe_2O_3+CO \rightarrow CO_2+2FeO$ FIG. 4B shows various temperature zones in a lit cigarette wherein zone A represents approximately 700 to 900° C., zone B represents approximately 200 to 600° C. and zone C represents approximately 30 to 200° C. The oxidant/catalyst dual function and the reaction temperature range make $Fe_2O_3$ nanoparticles a useful additive in cigarettes and tobacco mixtures for the reduction of carbon monoxide during smoking. Also, during the smoking of the cigarette, the $Fe_2O_3$ nanoparticles may be used initially as a catalyst (i.e. in the pyrolysis zone), and then as an oxidant (i.e. in the combustion region).

Various experiments to further study thermodynamic and kinetics of various catalysts were conducted using a quartz flow tube reactor. The kinetics equation governing these reactions is as follows:

$$ln(1-x)=-A_o e^{-(Ea/RT)} \bullet (s \bullet l/F)$$

where the variables are defined as follows:

x=the percentage of carbon monoxide converted to carbon dioxide $A_o$=the pre-exponential factor, $5\times10^{-6}$ $s^{-1}$ R=the gas constant, $1.987\times10^{-3}$ kcal/(mol•K)

Figure 5:
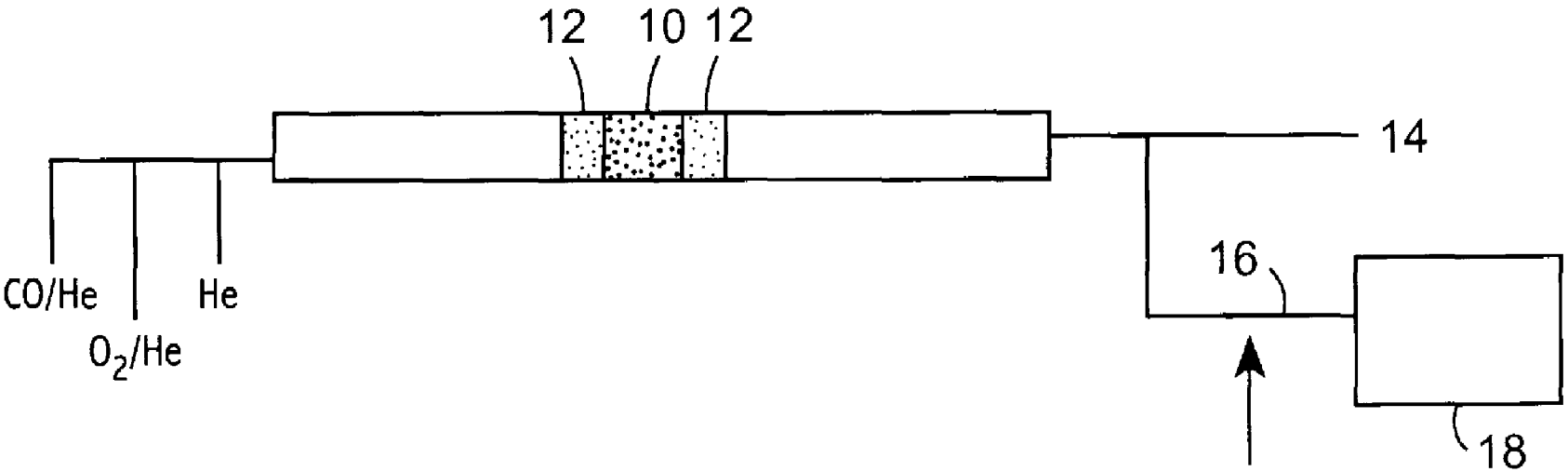
FIG. 5 depicts a schematic of a quartz flow tube reactor.

$E_a$=activation energy, 14.5 kcal/mol s=cross section of the flow tube, 0.622 $cm^2$ l=length of the catalyst, 1.5 cm F=flow rate, in $cm^3/s$ T=temperature A schematic of a quartz flow tube reactor, suitable for carrying out such studies, is shown in FIG. 5. Helium, oxygen/helium and/or carbon monoxide/helium mixtures may be introduced at one end of the reactor. A quartz wool 10 dusted with $Fe_2O_3$ nanoparticles is placed within the reactor between sections of quartz wool 12. The products exit the reactor at a second end, which comprises an exhaust 14 and a capillary line 16 to a Quadrupole Mass Spectrometer ("QMS") 18. The relative amounts of products can thus be determined for a variety of reaction conditions.

Figure 6:
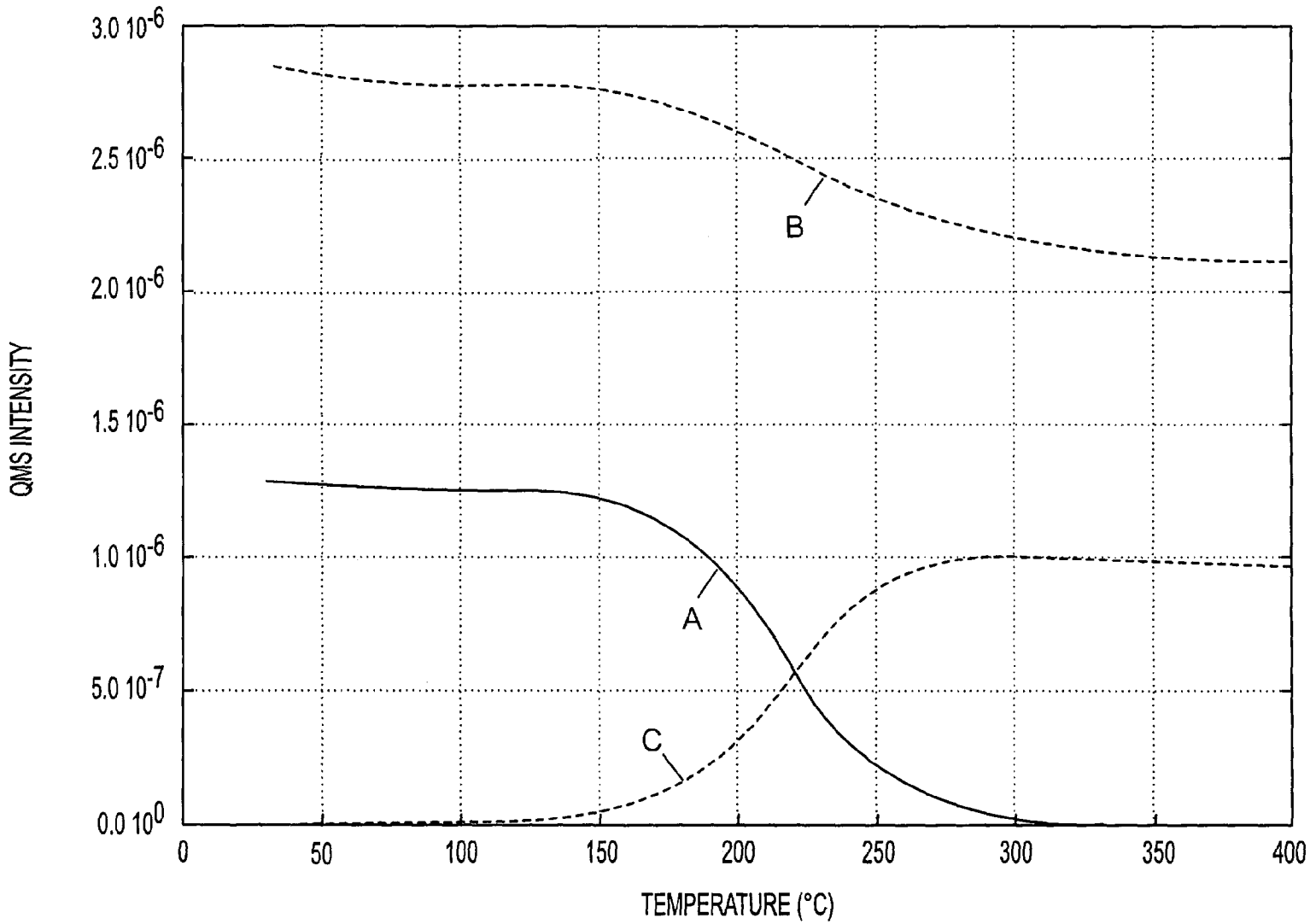
FIG. 6 illustrates the temperature dependence on the production of carbon monoxide, carbon dioxide and oxygen, when using $Fe_2O_3$ nanoparticles as the catalyst for the oxidation of carbon monoxide with oxygen to produce carbon dioxide.

FIG. 6 is a graph of temperature versus QMS intensity for a test wherein $Fe_2O_3$ nanoparticles are used as a catalyst for the reaction of carbon monoxide with oxygen to produce carbon dioxide. In the test, about 82 mg of $Fe_2O_3$ nanoparticles are loaded in the quartz flow tube reactor. Carbon monoxide is provided at 4% concentration in helium at a flow rate of about 270 mL/min, and oxygen is provided at 21% concentration in helium at a flow rate of about 270 mL/min. The heating rate is about 12.1 K/min. As shown in this graph wherein curve A represents CO, curve B represents $O_2$ and curve C represents $CO_2$, $Fe_2O_3$ nanoparticles are effective at converting carbon monoxide to carbon dioxide at temperatures above around 225° C.

Figure 7:
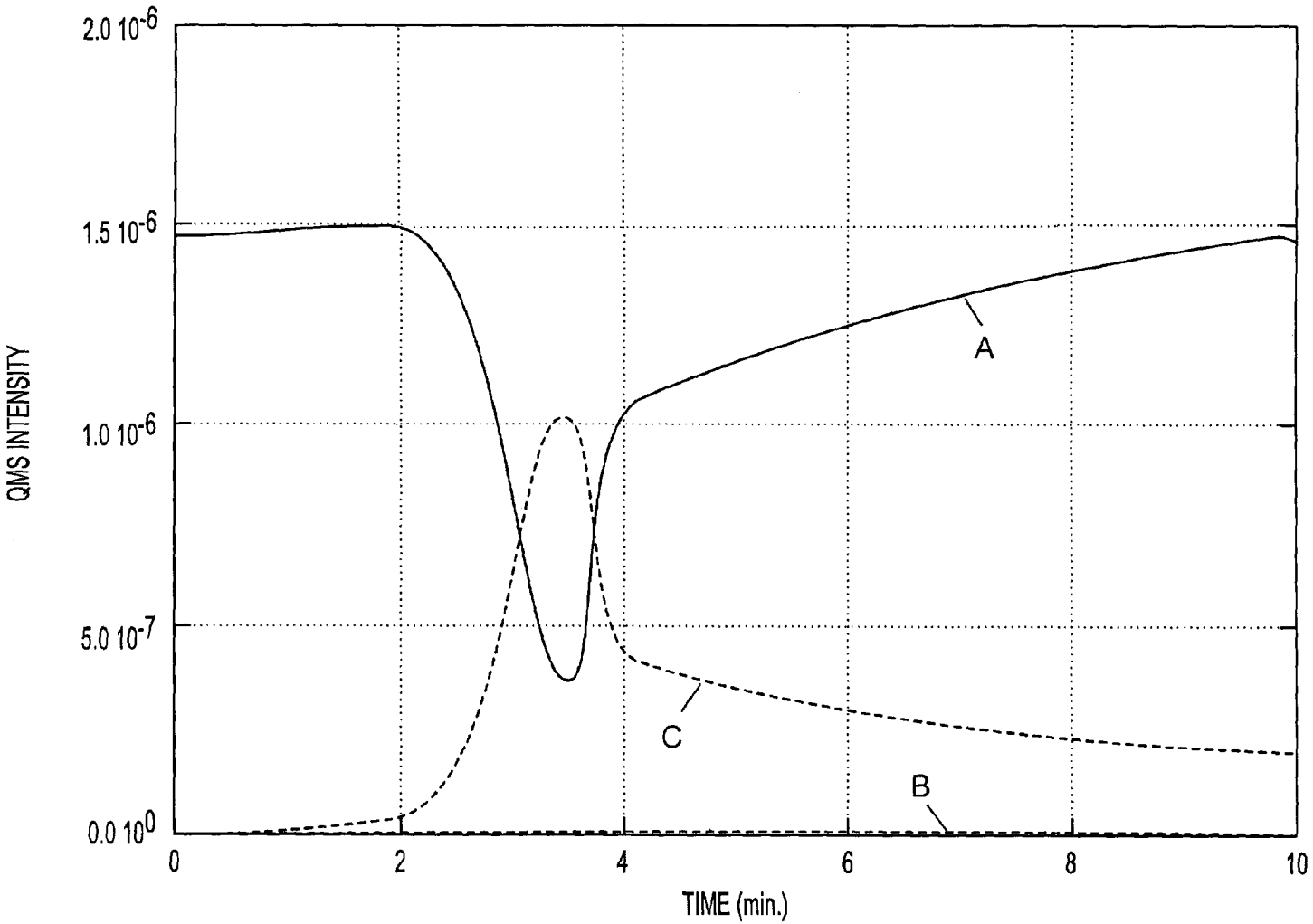
FIG. 7 illustrates the relative production of carbon monoxide, carbon dioxide and oxygen, when using $Fe_2O_3$ nanoparticles as an oxidant for the reaction of $Fe_2O_3$ with carbon monoxide to produce carbon dioxide and FeO.

FIG. 7 is a graph of time versus QMS intensity for a test wherein $Fe_2O_3$ nanoparticles are studied as an oxidant for the reaction of $Fe_2O_3$ with carbon monoxide to produce carbon dioxide and FeO. In FIG. 7, curve A represents CO, curve B represents $O_2$ and curve C represents $CO_2$. In the test, about 82 mg of $Fe_2O_3$ nanoparticles are loaded in the quartz flow tube reactor. Carbon monoxide is provided at 4% concentration in helium at a flow rate of about 270 mL/min, and the heating rate is about 137 K/min to a maximum temperature of 460° C. As suggested by data shown in FIGS. 6 and 7, $Fe_2O_3$ nanoparticles are effective in conversion of carbon monoxide to carbon dioxide under conditions similar to those during smoking of a cigarette.

Figure 8A:
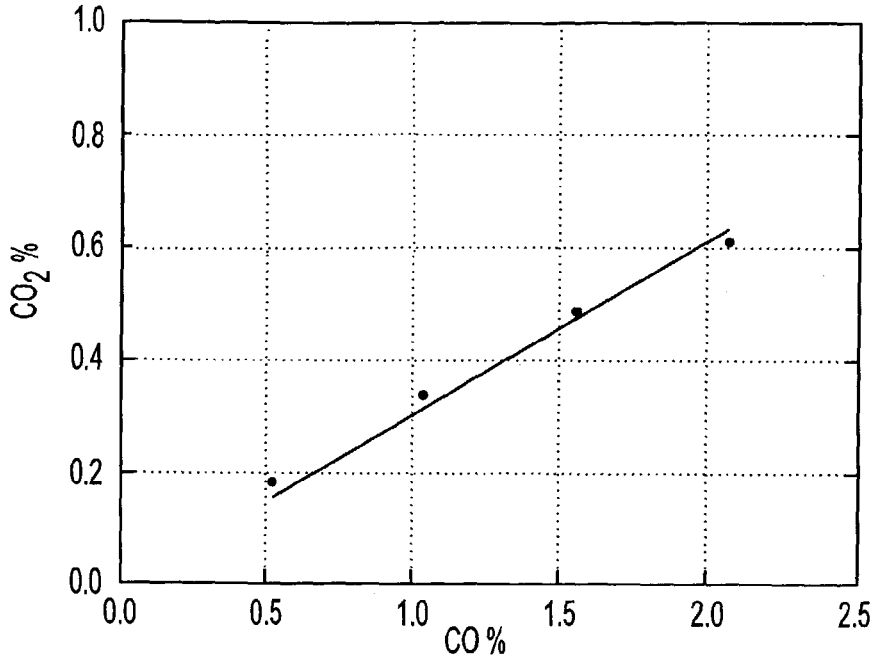
FIGS. 8A and 8B illustrate the reaction orders of carbon monoxide and carbon dioxide with $Fe_2O_3$ as a catalyst.
Figure 8B:
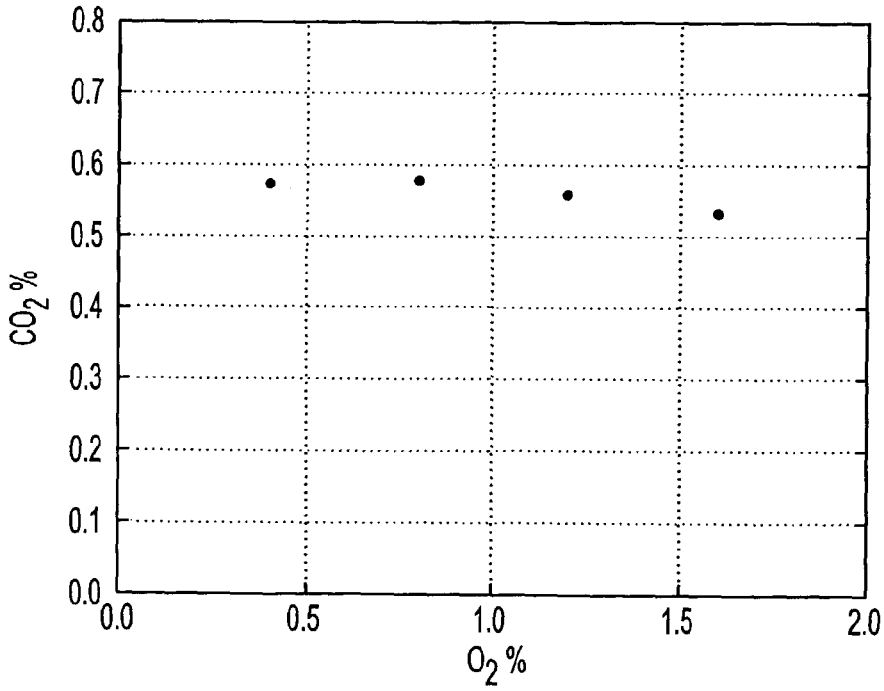
Figure 9:
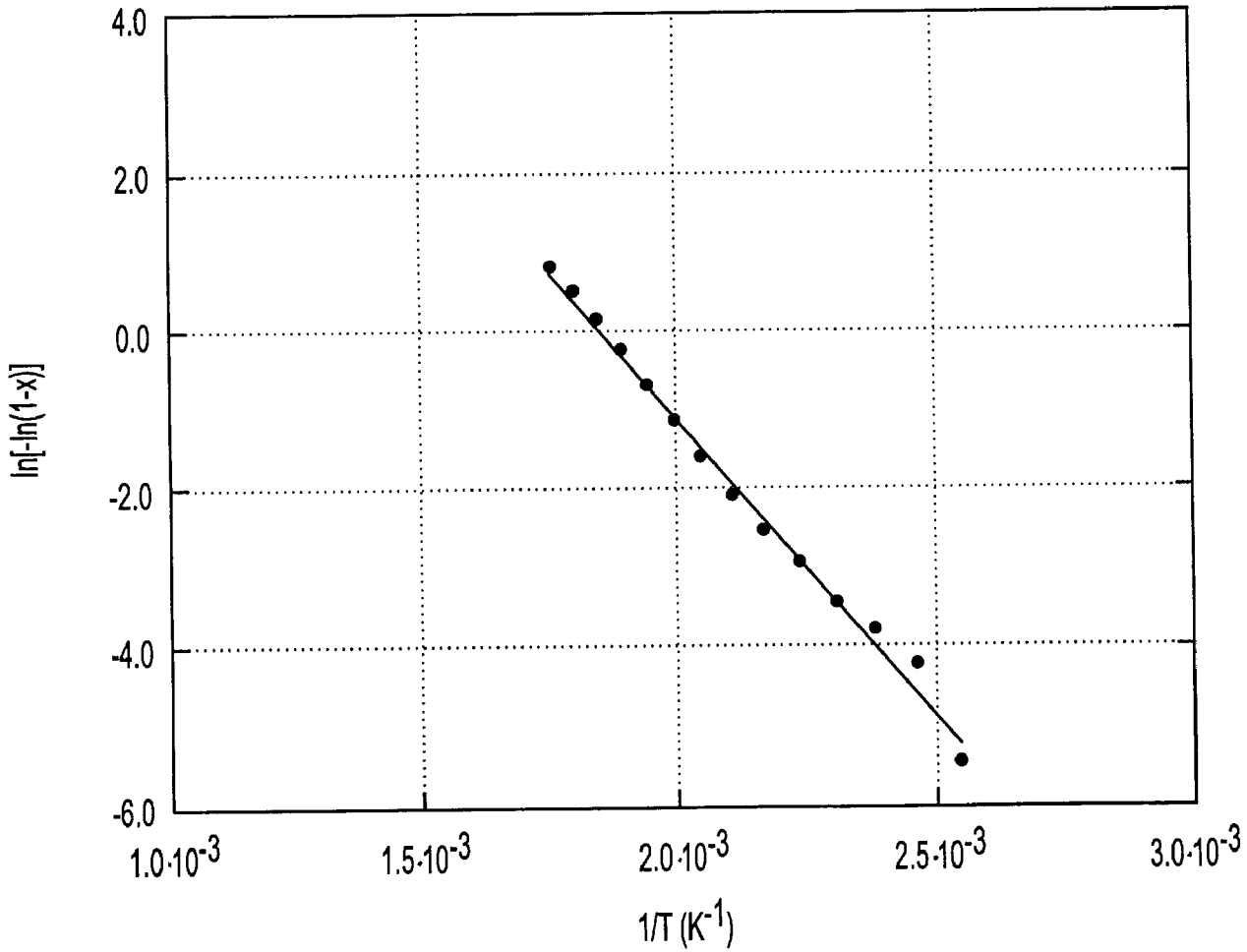
FIG. 9 depicts the measurement of the activation energy and the pre-exponential factor for the reaction of carbon monoxide with oxygen to produce carbon dioxide, using $Fe_2O_3$ nanoparticles as a catalyst for the reaction.

FIGS. 8A and 8B are graphs showing the reaction orders of carbon monoxide and carbon dioxide with $Fe_2O_3$ as a catalyst wherein T=218° C., flow rate=400 ml/min, catalyst=50 mg $Fe_2O_3$ and $O_2$ is provided at 11% concentration in FIG. 8A and T=255° C., flow rate=500 ml/min, catalyst=50 mg $Fe_2O_3$ and CO is provided at 0.79% concentration. FIG. 9 depicts the measurement of the activation energy and the pre-exponential factor for the reaction of carbon monoxide with oxygen to produce carbon dioxide, using $Fe_2O_3$ nanoparticles as a catalyst for the reaction with 4% CO in He at 100 ml/min and 2% $O_2$ in He at 200 ml/min. A summary of activation energies is provided in Table 1.

TABLE 1

Summary of the Activation Energies and Pre-exponential Factors

| | Flow Rate (mL/min) | CO % | $O_2$ % | $A_o$ ($s^{-1}$) | $E_a$ (kcal/mol) |
|---|---|---|---|---|---|
| 1 | 300 | 1.32 | 1.34 | $1.8 \times 10^7$ | 14.9 |
| 2 | 900 | 1.32 | 1.34 | $8.2 \times 10^6$ | 14.7 |
| 3 | 1000 | 3.43 | 20.6 | $2.3 \times 10^6$ | 13.5 |
| 4 | 500 | 3.43 | 20.6 | $6.6 \times 10^6$ | 14.3 |
| 5 | 250 | 3.42 | 20.6 | $2.2 \times 10^7$ | 15.3 |
| AVG. | | | | $5 \times 10^6$ | 14.5 |
| Ref. | | | | | |
| 1 | Gas Phase | | | | 39.7 |
| 2 | 2% $Au/TiO_2$ | | | | 7.6 |
| 3 | 2.2% $Pd/Al_2O_3$ | | | | 9.6 |

Figure 10:
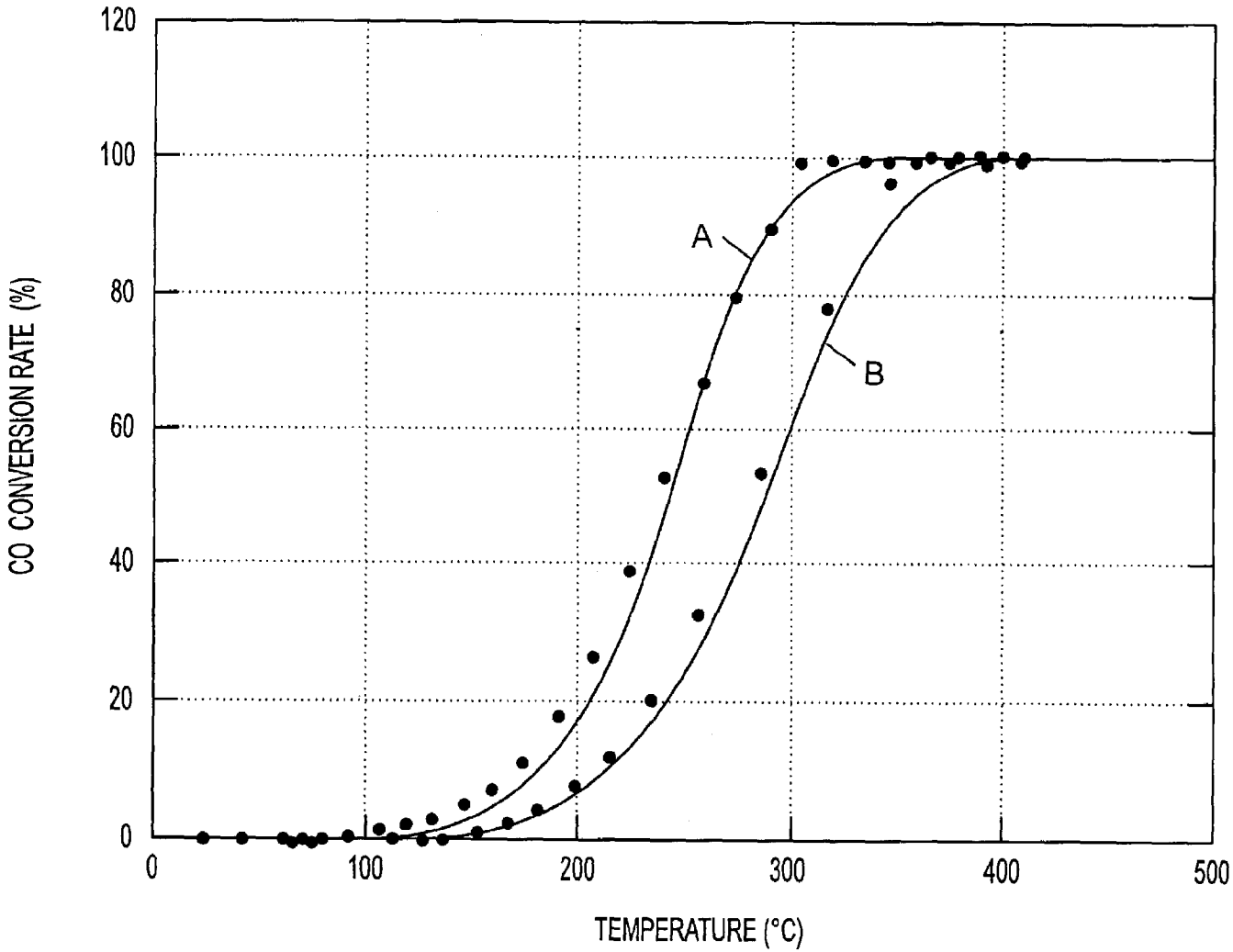
FIG. 10 depicts the temperature dependence for the conversion rate of carbon monoxide, for flow rates of 300 mL/min and 900 mL/min respectively.

FIG. 10 depicts the temperature dependence for the conversion rate of carbon monoxide using 50 mg $Fe_2O_3$ nanoparticles as catalyst in the quartz tube reactor with He containing 1.32% CO and 1.34% $O_2$ flowing through the reactor, for flow rates of 300 mL/min (curve A) and 900 mL/min (curve B) respectively.

Figure 11:
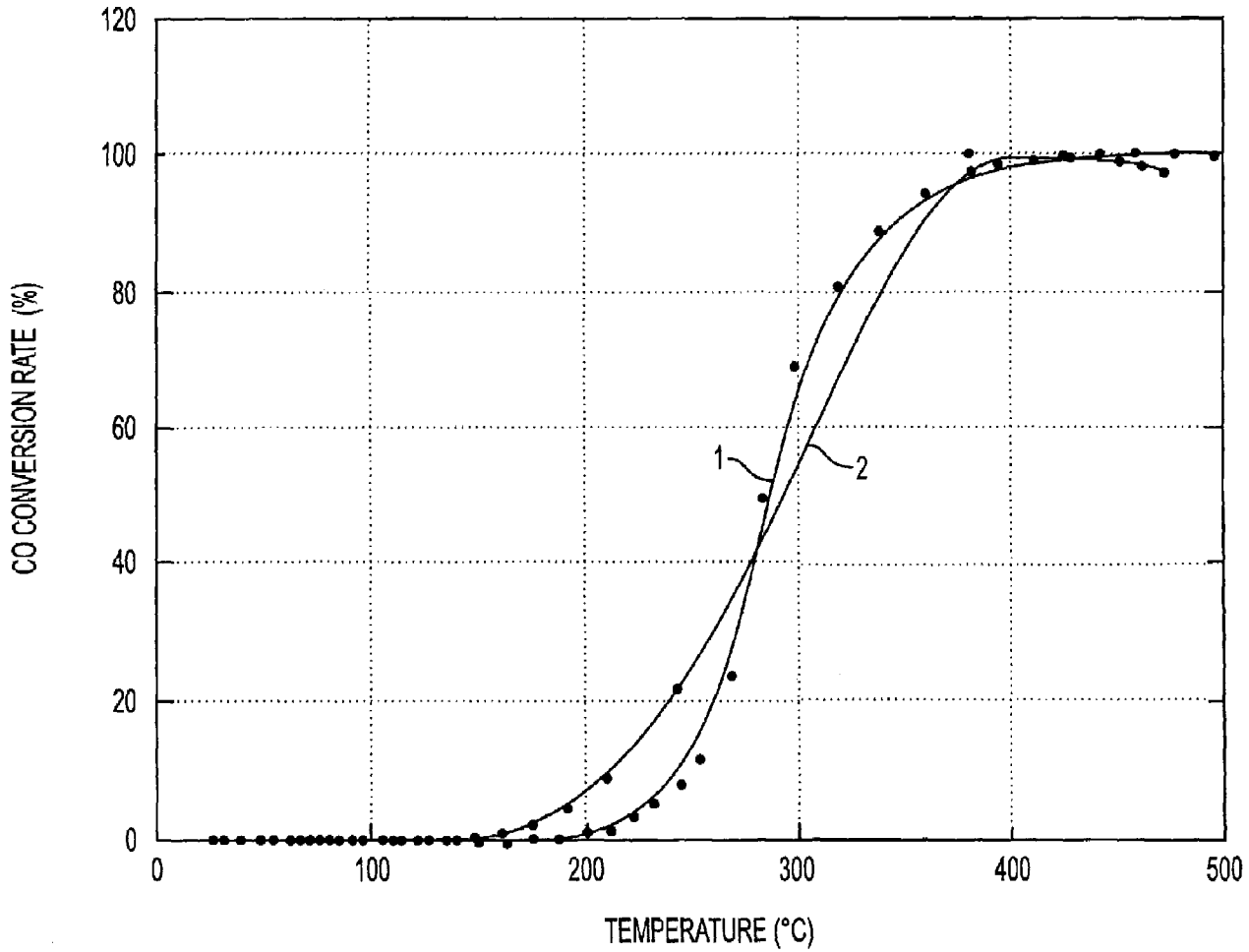
FIG. 11 depicts contamination and deactivation studies for water wherein curve 1 represents the condition for 3% $H_2O$ and curve 2 represents the condition for no $H_2O$.

FIG. 11 depicts contamination and deactivation studies for water using 50 mg $Fe_2O_3$ nanoparticles as catalyst in the quartz tube reactor with flow rate of 1000 ml/min He containing 3.4% CO and 21% $O_2$ and heating rate of 12.4 K/min. As can be seen from the graph, compared to curve 1 (without water), the presence of up to 3% water (curve 2) has little effect on the ability of $Fe_2O_3$ nanoparticles to convert carbon monoxide to carbon dioxide.

Figure 12:
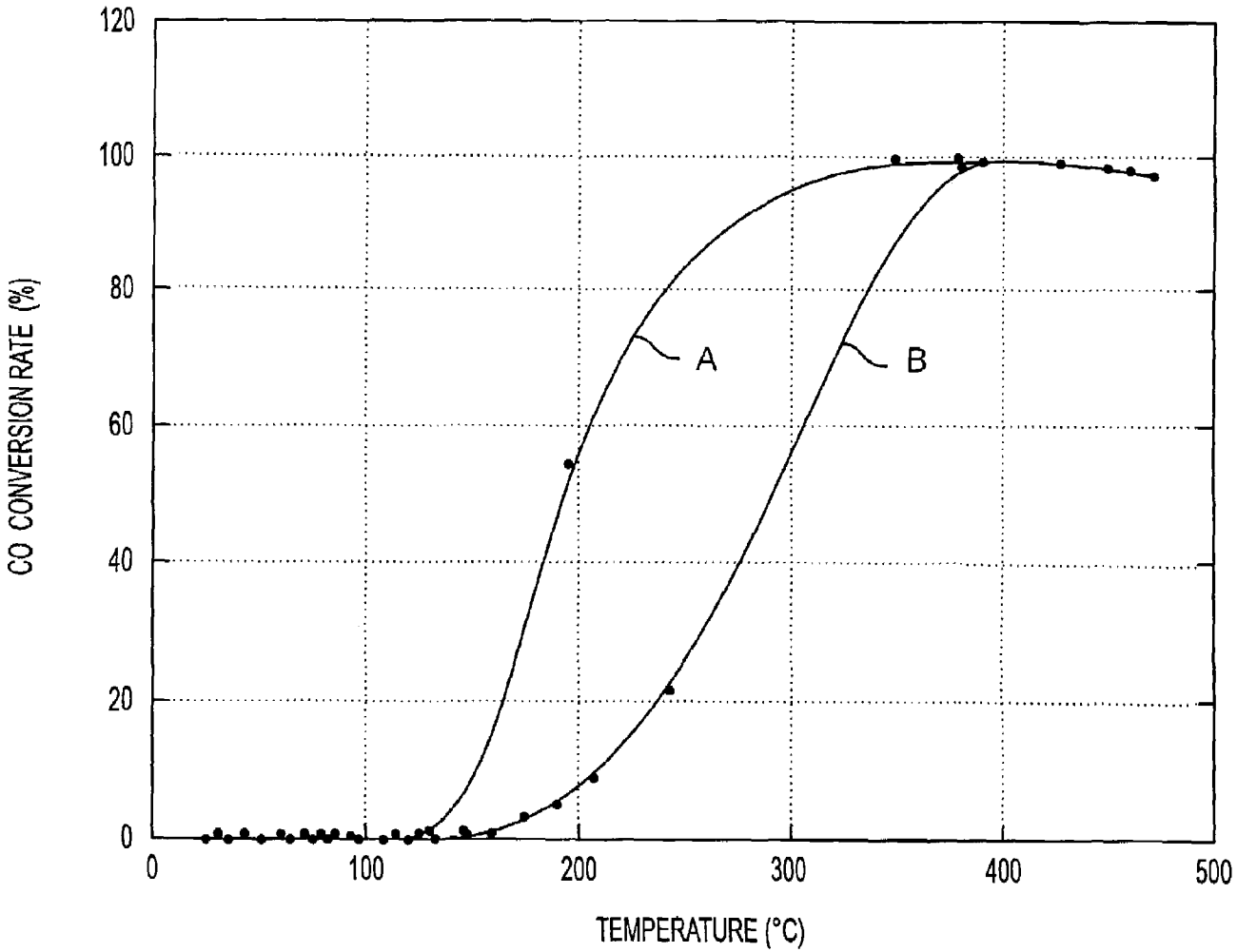
FIG. 12 depicts the temperature dependence for the conversion rates of CuO and $Fe_2O_3$ nanoparticles as catalysts for the oxidation of carbon monoxide with oxygen to produce carbon dioxide.

FIG. 12 illustrates a comparison between the temperature dependence of conversion rate for CuO and $Fe_2O_3$ nanoparticles using 50 mg $Fe_2O_3$ and 50 mg CuO nanoparticles as catalyst in the quartz tube reactor with flow rate of 1000 ml/min He containing 3.4% CO and 21% $O_2$ and heating rate of 12.4 K/min. Although the CuO nanoparticles have higher conversion rates at lower temperatures, at higher temperatures (curve A) than for $Fe_2O_3$ (curve B), the CuO and $Fe_2O_3$ have the same conversion rates.

Figure 13:
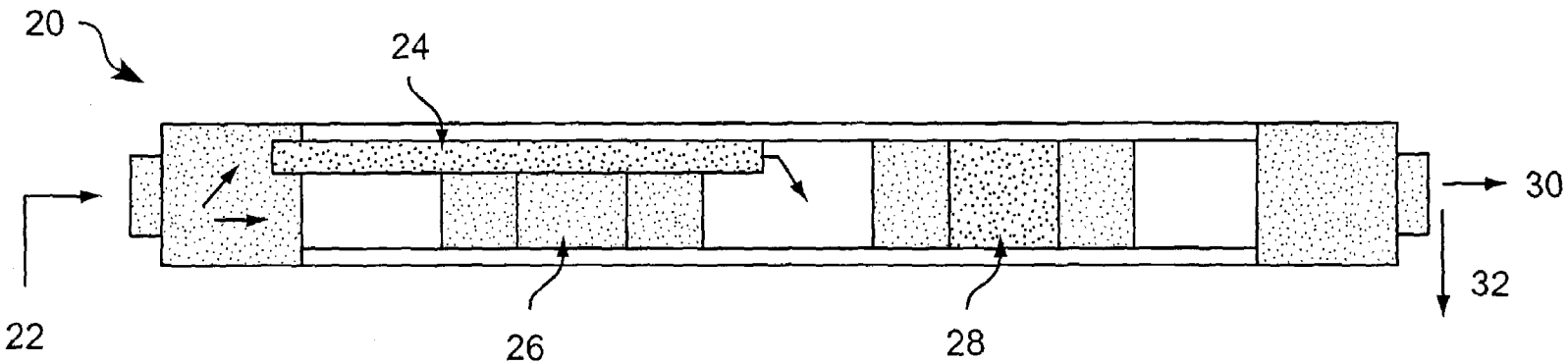
FIG. 13 depicts a flow tube reactor to simulate a cigarette in evaluating different nanoparticle catalysts.

FIG. 13 shows a flow tube reactor to simulate a cigarette in evaluating different nanoparticle catalysts wherein the reactor 20 includes an inlet 22 for 21% $O_2$ in He, ⅛ inch stainless steel tubing 24, tobacco filler 26, $Fe_2O_3$ or other oxides dusted on quartz wool 28, vent 30 and QMS analyzer 32. Table 2 shows a comparison between the ratio of carbon monoxide to carbon dioxide, and the percentage of oxygen depletion when using CuO, $Al_2O_3$, and $Fe_2O_3$ nanoparticles.

TABLE 2

Comparison between CuO, $Al_2O_3$, and $Fe_2O_3$ nanoparticles

| Nanoparticle | $CO/CO_2$ | $O_2$ Depletion (%) |
|---|---|---|
| None | 0.51 | 48 |
| $Al_2O_3$ | 0.40 | 60 |
| CuO | 0.29 | 67 |
| $Fe_2O_3$ | 0.23 | 100 |

In the absence of nanoparticles, the ratio of carbon monoxide to carbon dioxide is about 0.51 and the oxygen depletion is about 48%. The data in Table 2 illustrates the improvement obtained by using nanoparticles. The ratio of carbon monoxide to carbon dioxide drops to 0.40, 0.29, and 0.23 for $Al_2O_3$, CuO and $Fe_2O_3$ nanoparticles, respectively. The oxygen depletion increases to 60%, 67% and 100% for $Al_2O_3$, CuO and $Fe_2O_3$ nanoparticles, respectively.

Figure 14:
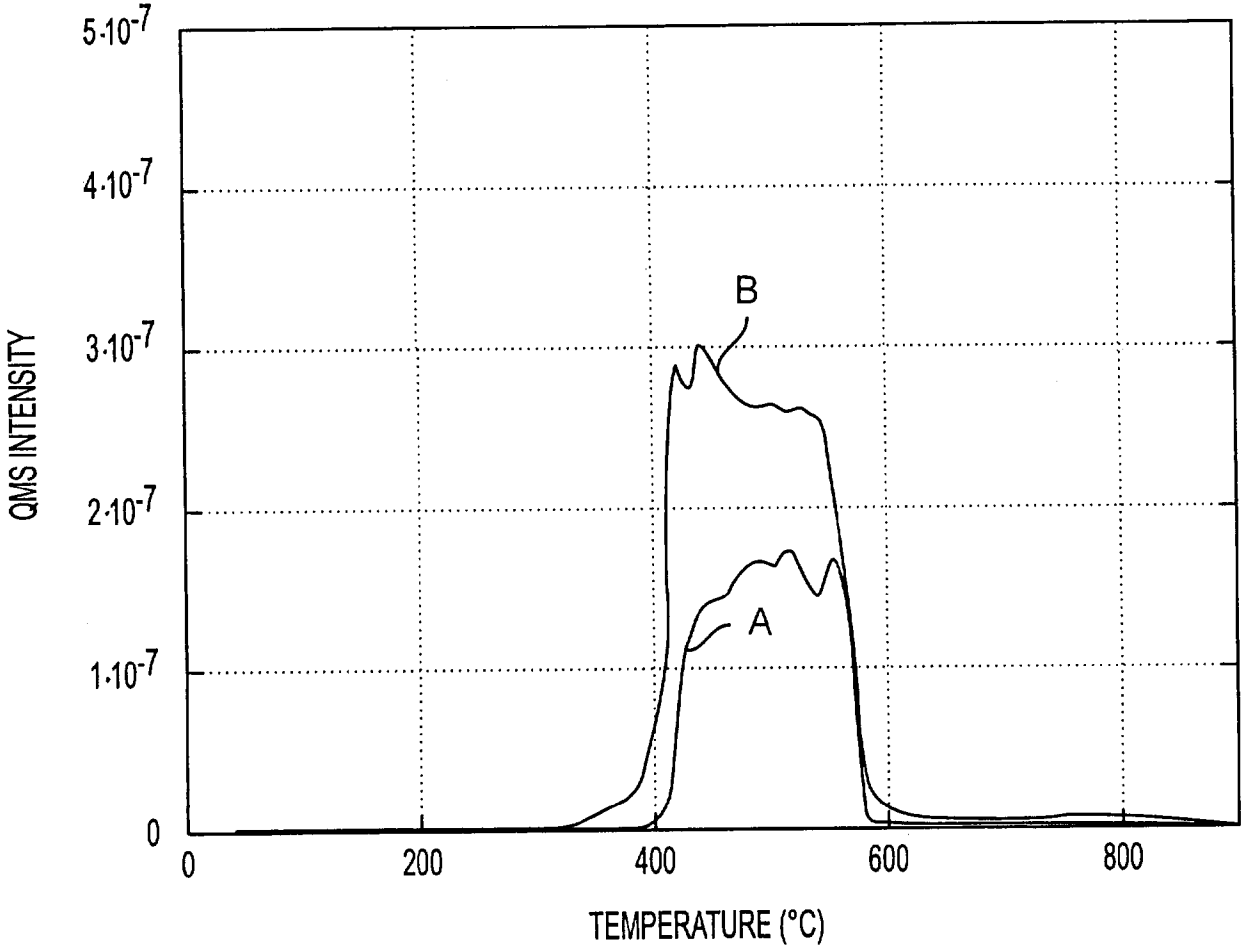
FIG. 14 depicts the relative amounts of carbon monoxide and carbon dioxide production without a catalyst present.
Figure 15:
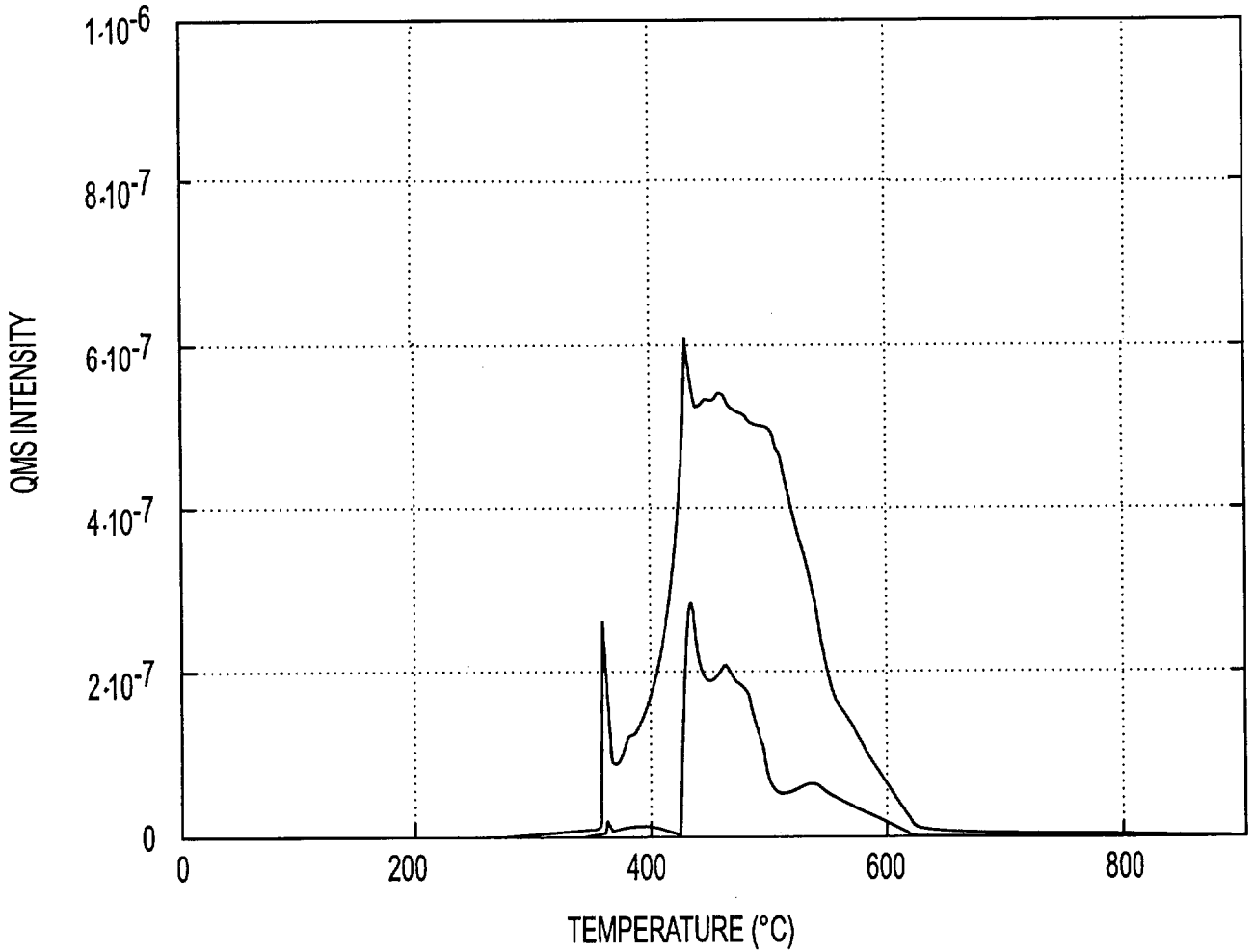
FIG. 15 depicts the relative amounts of carbon monoxide and carbon dioxide production with a catalyst present.

FIG. 14 is a graph of temperature versus QMS intensity in a test which shows the amounts of carbon monoxide (curve A) and carbon dioxide (curve B) production without a catalyst present using 1000 ml/min He containing 21% $O_2$, 350 mg tobacco and heating rate of 120 K/min. FIG. 15 is a graph of temperature versus QMS intensity in a test which shows the amounts of carbon monoxide and carbon dioxide production when using 50 mg $Fe_2O_3$ nanoparticles as a catalyst with 1000 ml/min He containing 21% $O_2$, 350 mg tobacco and heating rate of 120 K/min. As can be seen by comparing FIG. 14 and FIG. 15, the presence of $Fe_2O_3$ nanoparticles increases the ratio of carbon dioxide to carbon monoxide present, and decreases the amount of carbon monoxide present.

Figure 16:
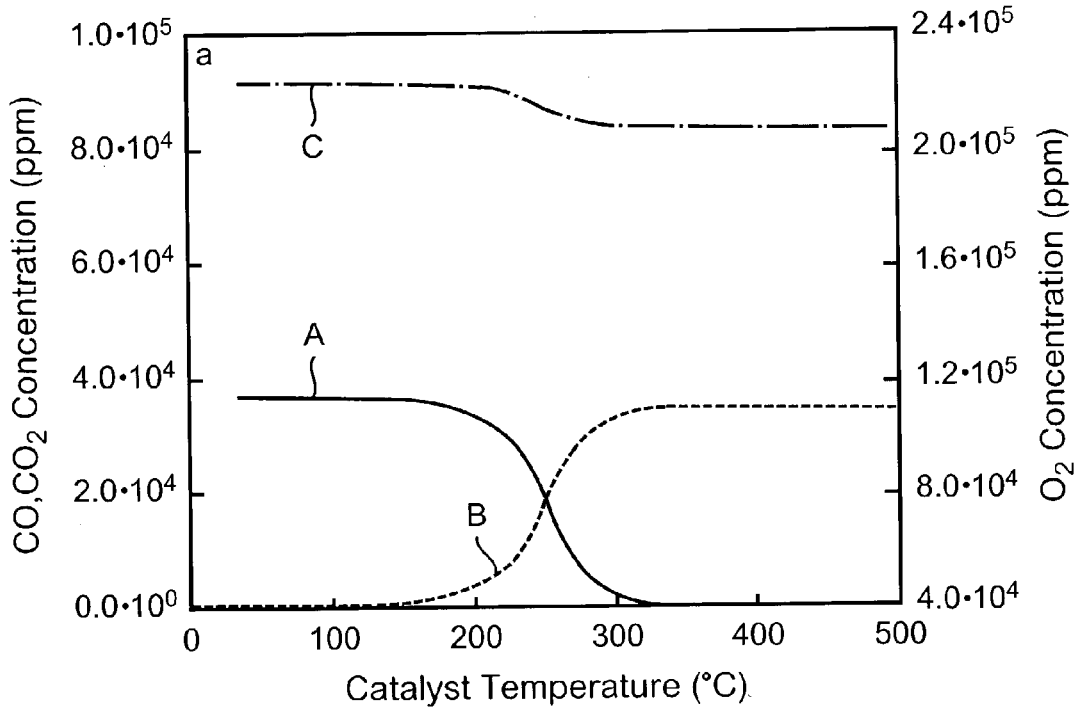
FIG. 16 shows the effect of oxidation of carbon monoxide without isoprene in the gas stream.
Figure 17:
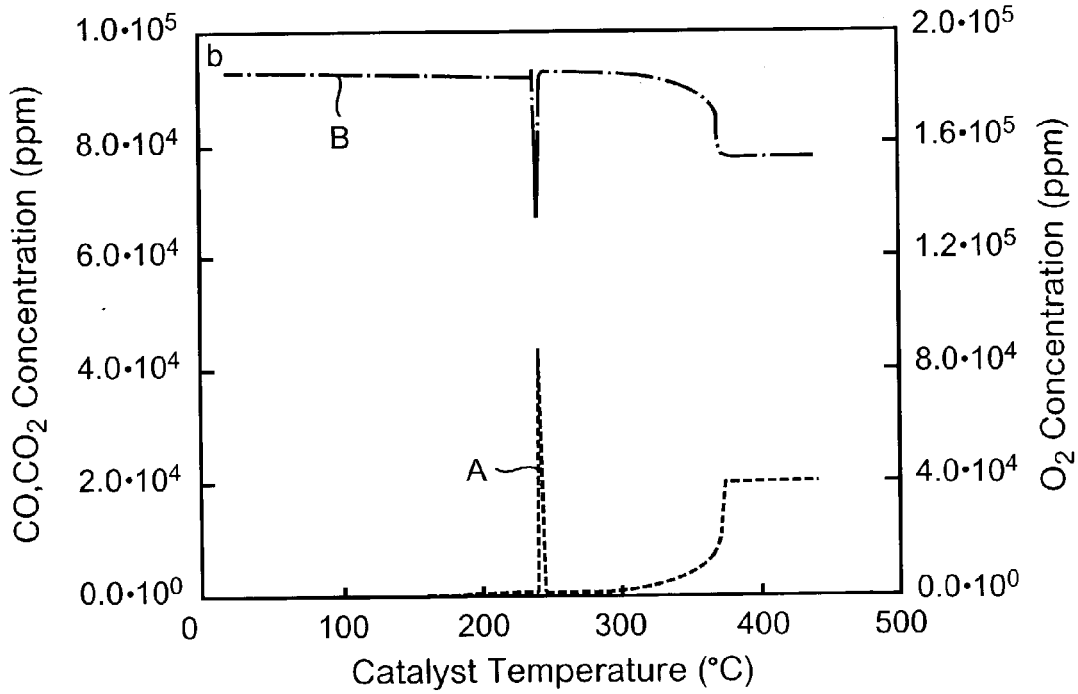
FIG. 17 shows the oxidation of isoprene without the presence of carbon monoxide in the gas stream.
Figure 18:
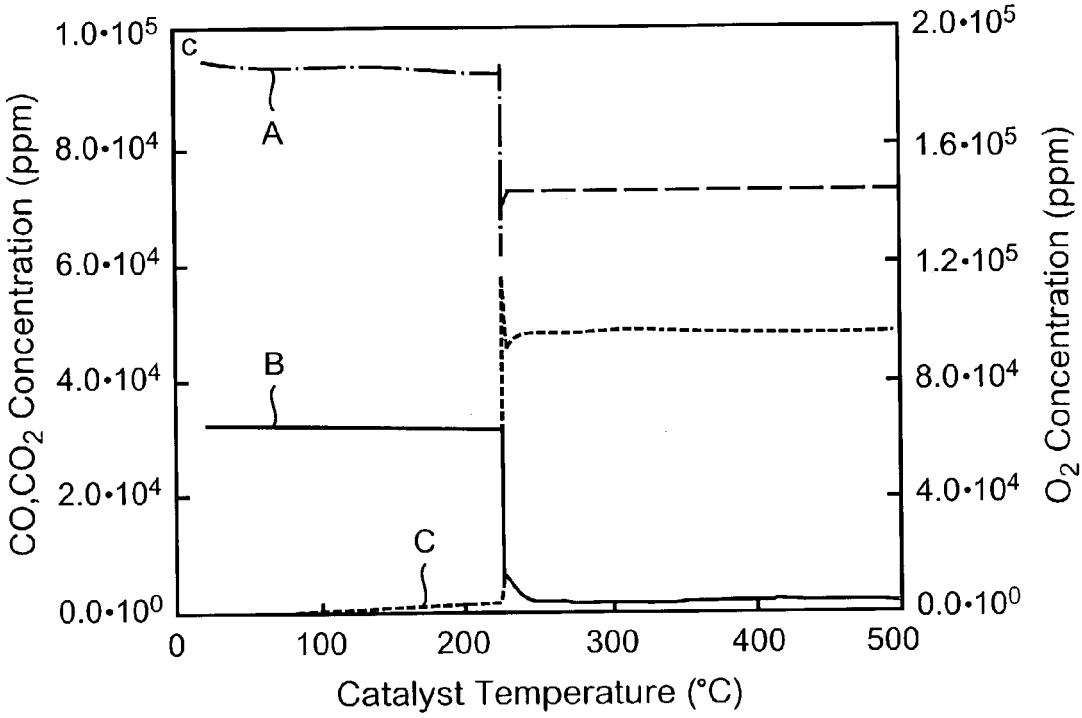
FIG. 18 shows the effect of simultaneous oxidation of carbon monoxide and isoprene.

Experiments were carried out in a quartz flow tube to study the effect of the iron oxide nanoparticles on reduction of carbon monoxide and isoprene in separate and combined gas flows. The concentration of carbon monoxide, carbon dioxide and oxygen was measured by an NLT 2000 multi-gas analyzer. The concentration range of isoprene (not shown) was measured by a Balzer Quadropole Mass Spectrometer (QMS). In the experiments, 50 mg of iron oxide nanoparticles were used and the total inlet gas flow rate was 1000 ml/min. During the experiments, the heating rate was 12° C./minute. FIG. 16 shows the concentration of CO (curve A), $CO_2$ (curve B) and $O_2$ (curve C) and establishes that in the absence of isoprene in the gas flow, the conversion of carbon monoxide to carbon dioxide reached 100% at about 350° C. In the absence of carbon monoxide in the gas stream, the complete oxidation of isoprene took place at about 375° C. as shown in FIG. 17 which shows the concentration of $CO_2$ (curve A) and $O_2$ (curve B) and also shows the presence of a short burst of oxidation at about 240° C. The addition of isoprene (6000 ppm) to the carbon monoxide containing gas stream promotes the carbon monoxide oxidation as shown in FIG. 18 which shows the concentration of $O_2$ (curve A), CO (curve B) and $CO_2$ (curve C) Essentially 100% conversion of carbon monoxide was observed at about 225° C. and the isoprene was completely oxidized to carbon dioxide and water at the same time as evidenced by the extra carbon dioxide production and the extra oxygen consumption. It was further confirmed by QMS observation of the abrupt decrease of the intensity of m/e=68 (isoprene) to 0 and the increase of intensities of m/e=18 ($H_2O$) and m/e=44 ($CO_2$). The analysis of the gas concentration changes in FIG. 18 confirms the following reactions occurred simultaneously:

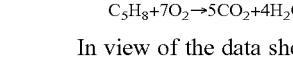

$$CO+\tfrac{1}{2}O_2 \rightarrow CO_2$$

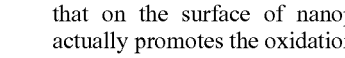

$$C_5H_8+7O_2 \rightarrow 5CO_2+4H_2O$$

Figure 19:
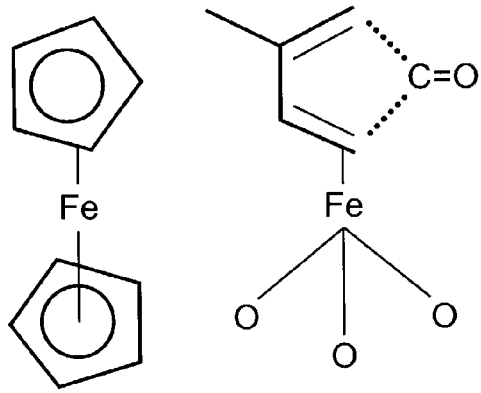
FIG. 19 is a proposed model of a cyclopentadienyl-like structure on the iron oxide surface of the catalyst material.

In view of the data shown in FIGS. 16–18, it is believed that on the surface of nanoparticle iron oxide isoprene actually promotes the oxidation of carbon monoxide instead of repressing it and that carbon monoxide also promotes the oxidation of isoprene. A similar effect was not observed for the oxidation of carbon monoxide and propene which has only one C═C double bond. Thus, it is theorized that some kind of concerted effect between carbon monoxide and the conjugated double bond containing compounds occurs in the presence of the nanoparticle iron oxide. A possible explanation is that the formation of a cyclopentadienyl-like structure between the carbon monoxide and the conjugated double bond on top of the iron atom of the iron oxide nanoparticle. A cyclopentadienyl-like structure and $(Cp)_2Fe$ is shown in FIG. 19. Nanoparticle iron oxide, with the higher population of the coordinate-unsaturated iron site due to its small particle size, might be able to facilitate this surface complex and keep both carbon monoxide and isoprene close to the surface. It is expected that other types of conjugated double bond containing compounds such as acrolein would undergo the same reaction.

The nanoparticle catalyst can effect reduction of various constituents in mainstream and sidestream tobacco. Examples of constituents in mainstream that may be removed include, but are not limited to, aldehydes, carbon monoxide, 1,3-butadiene, isoprene, acrolein, acrylonitrile, hydrogen cyanide, o-toluidine, 2-naphtylamine, nitrogen oxide, benzene, N-nitrosonornicotine, phenol, catechol, benz(a)anthracene, and/or benzo(a)pyrene. With respect to isoprene, With respect to isoprene, in tests of three cigarettes containing 24 mg of NANOCAT® in the tobacco rod, the average isoprene content in mainstream smoke was reduced to 286.3 mg compared to 413.6 mg for control cigarettes tested in the FTC condition.

It is known that substituted phenols are present in cigarette smoke. In order to study the effect of nanoparticle catalysts on reduction of such substituted phenols, catechol ($C_6H_4(OH_2)$) was selected as a phenolic model compound. The gas phase cracking of catechol over nano-particle iron oxide was studied in a flow tube reactor set up for catalytic cracking using a molecular beam mass spectrometer for realtime sampling from the reaction system and factor analysis to deconvolute complex chemistry. The effects of catechol/iron oxide ratio and temperature on catalytic activity and cracking product distribution were studied in partial oxidation conditions, i.e., 3% oxygen in an inert atmosphere.

The cracking study was carried out under atmospheric pressure in the temperature range from 350 to 650° C. with about 10 milli seconds contact time. The ratio in weight % of substrate to catalyst was varied from 1:1 to 10:1.

Figure 20:
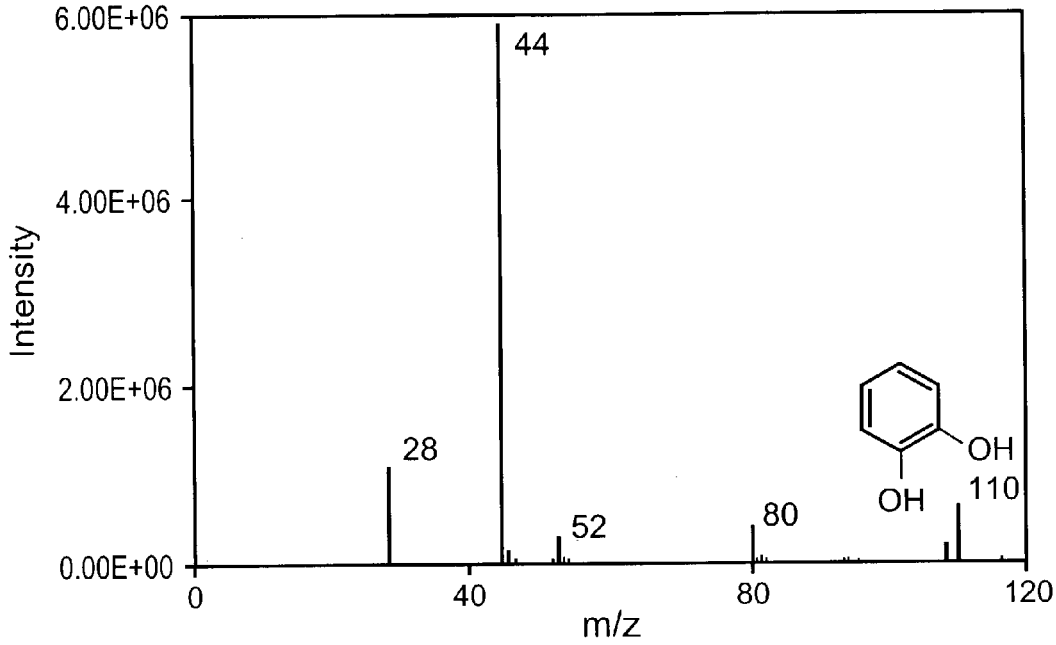
FIG. 20 shows the product distribution for conversion of catechol at 350° C. with a 1:1 weight % ratio of substrate to catalyst using 2 mg catechol and 2.5 mg NANOCAT® catalyst.
Figure 21:
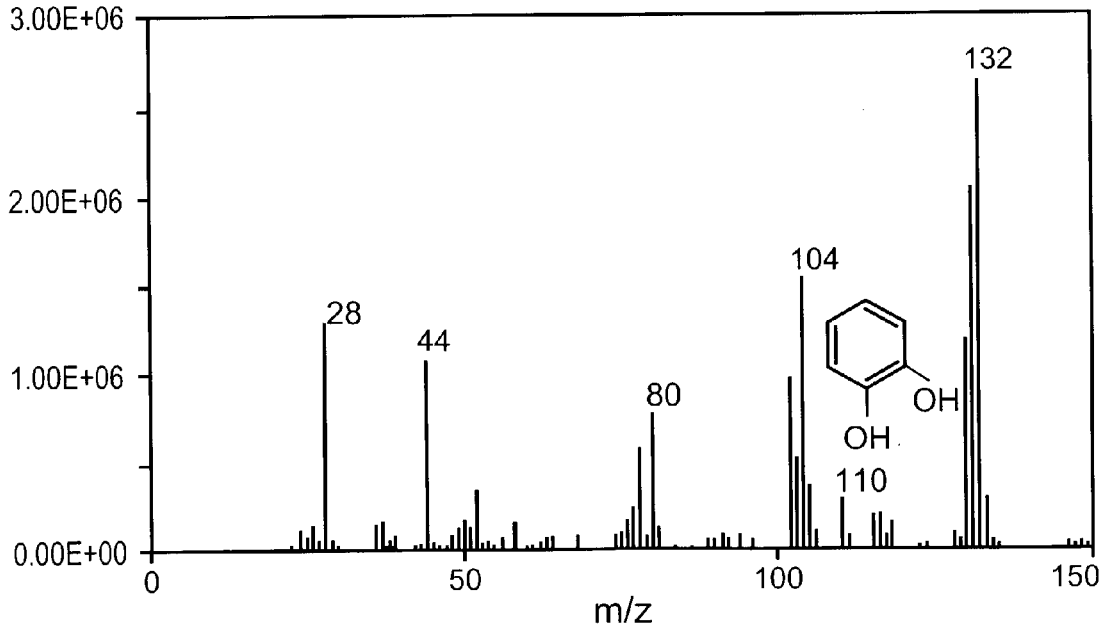
FIG. 21 shows the product distribution for conversion of catechol at 600° C. in the absence of a catalyst using 2 mg catechol.

Catechol (m/e=110) is thermally stable and requires high temperature (i.e., above 500° C.) to begin decomposing. However, significant cracking of catechol was observed even at 350° C. in the presence of the nanoparticle catalyst. Catechol underwent extensive conversion for the 1:1 substrate/catalyst ratio at 350° C. over nano-particle iron oxide. The product distribution in the catalytic cracking of catechol at these conditions is given in FIG. 20 where dominant products are found at m/e=44 (carbon dioxide) and m/e=28 (carbon monoxide) which could be partially derived from carbon dioxide fragmentation in the ionization process. This can be compared with the product spectrum resulting from thermo-chemical conversion of catechol at 600° C. (FIG. 21) where catechol decomposed to the same extent as that observed over the catalyst at 350° C. It is apparent from the figures that thermal conversion of catechol in the absence of the catalyst promoted the formation of compounds with the aromatic ring intact such as thyrene (m/e=104) and indanone (m/e=132) by secondary reactions. The growth of molecular weight to form polycyclic aromatic compounds in the pyrolysis of catechol has been previously observed. These results indicate that using nanoparticle iron oxide and thermo-chemical conversion processes enhances complete cracking of phenolic compounds such as catechol to generate neutral products such as carbon dioxide and water.

Figure 22:
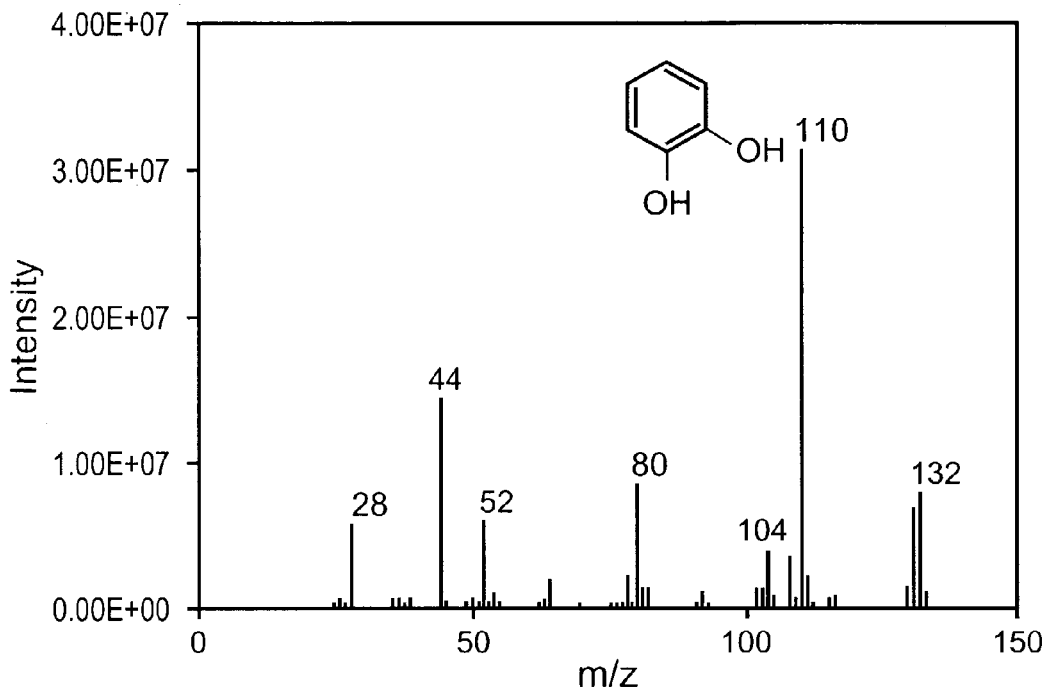
FIG. 22 shows the product distribution for conversion of catechol at 350° C. with a 10:1 weight % ratio of substrate to catalyst using 20 mg catechol and 2.5 mg NANOCAT® catalyst.
Figure 23:
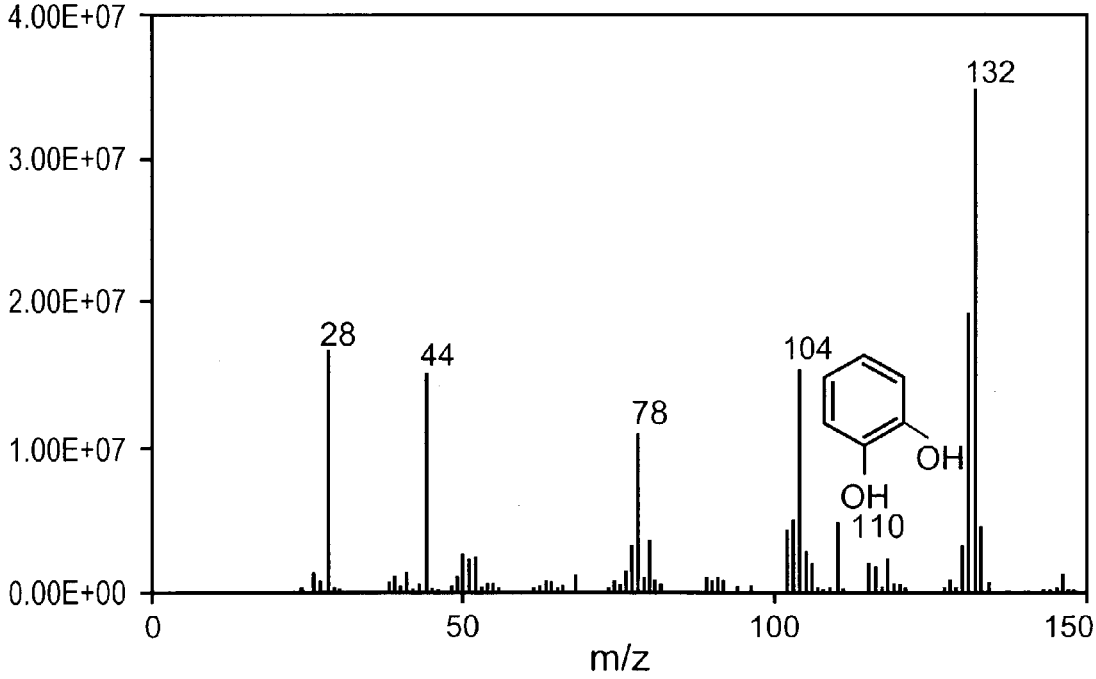
FIG. 23 shows the product distribution for conversion of catechol at 650° C. with a 10:1 weight % ratio of substrate to catalyst using 20 mg catechol and 2.5 mg NANOCAT® catalyst.

For the 10:1 substrate/catalyst ratio at 350° C., the decomposition of catechol was suppressed by the formation of higher molecular weight compounds such as m/e=132 as shown in FIG. 22. At higher temperatures, the formation of compounds with an aromatic ring was promoted at the expense of catechol. Comparable conversion of catechol for the 10:1 and 1:1 ratios was observed at 650° C. (FIG. 23) and 350° C. (FIG. 20), respectively, while product distribution was completely different. This can be attributed to secondary reactions at higher temperatures and catechol concentration. Catechol conversion and product distribution over nano-particle iron oxide were dependent on sample/catalyst ratio and temperature. Therefore, having optimum process parameters can alter reaction products.

The nanoparticle additives, as described above, may be provided along the length of a tobacco rod by distributing the additive nanoparticles on the tobacco or incorporating them into the cut filler tobacco using any suitable method. The nanoparticles may be provided in the form of a powder or in a solution in the form of a dispersion. In a preferred method, nanoparticle additives in the form of a dry powder are dusted on the cut filler tobacco. The nanoparticle additives may also be present in the form of a solution and sprayed on the cut filler tobacco. Alternatively, the tobacco may be coated with a solution containing the nanoparticle additives. The nanoparticle additive may also be added to the cut filler tobacco stock supplied to the cigarette making machine or added to a tobacco rod prior to wrapping cigarette paper around the cigarette rod.

The nanoparticle additives will preferably be distributed throughout the tobacco rod portion of a cigarette and optionally the cigarette filter. By providing the nanoparticle additives throughout the entire tobacco rod, it is possible to reduce the amount of carbon monoxide throughout the cigarette, and particularly at both the combustion region and in the pyrolysis zone. Further, the nanoparticle additive can reduce other constituents of mainstream and/or sidestream tobacco smoke, such constituents including aldehydes such as acetaldehyde or acrolein, hydrocarbons such as isoprene and phenolic compounds such as catechol.

The amount of the nanoparticle additive should be selected such that the amount of carbon monoxide in mainstream smoke is reduced during smoking of a cigarette. Preferably, the amount of the nanoparticle additive will be from about a few milligrams, for example, 5 mg/cigarette, to about 100 mg/cigarette. More preferably, the amount of nanoparticle additive will be from about 40 mg/cigarette to about 50 mg/cigarette.

One embodiment of the invention relates to a cut filler composition comprising tobacco and at least one additive, as described above, which is capable of acting as an oxidant for the conversion of carbon monoxide to carbon dioxide and/or as a catalyst for the conversion of carbon monoxide to carbon dioxide, where the additive is in the form of nanoparticles. Further, the nanoparticle additive can reduce other constituents of mainstream and/or sidestream tobacco smoke, such constituents including aldehydes such as acetaldehyde or acrolein, hydrocarbons such as isoprene and phenolic compounds such as catechol.

Any suitable tobacco mixture may be used for the cut filler. Examples of suitable types of tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The invention may also be practiced with tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

Another embodiment of the invention relates to a cigarette comprising a tobacco rod, wherein the tobacco rod comprises cut filler having at least one additive, as described above, which is capable of acting as an oxidant for the conversion of carbon monoxide to carbon dioxide and/or as a catalyst for the conversion of carbon monoxide to carbon dioxide, wherein the additive is in the form of nanoparticles. A further embodiment of the invention relates to a method of making a cigarette, comprising (i) adding an additive to a cut filler, wherein the additive, as described above, which is capable of acting as an oxidant for the conversion of carbon monoxide to carbon dioxide and/or as a catalyst for the conversion of carbon monoxide to carbon dioxide, wherein the additive is in the form of nanoparticles; (ii) providing the cut filler comprising the additive to a cigarette making machine to form a tobacco rod; and (iii) placing a paper wrapper around the tobacco rod to form the cigarette. Further, the nanoparticle additive can reduce other constituents of mainstream and/or sidestream tobacco smoke, such constituents including aldehydes such as acetaldehyde or acrolein, hydrocarbons such as isoprene and phenolic compounds such as catechol.

Techniques for cigarette manufacture are known in the art. Any conventional or modified cigarette making technique may be used to incorporate the nanoparticle additives. The resulting cigarettes can be manufactured to any known specifications using standard or modified cigarette making techniques and equipment. Typically, the cut filler composition of the invention is optionally combined with other cigarette additives, and provided to a cigarette making machine to produce a tobacco rod, which is then wrapped in cigarette paper, and optionally tipped with filters.

The cigarettes of the invention may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 mg/cm$^3$ to about 300 mg/cm$^3$, and preferably 150 mg/cm$^3$ to about 275 mg/cm$^3$.

Yet another embodiment of the invention relates to a method of smoking the cigarette described above, which involves lighting the cigarette to form smoke and drawing the smoke through the cigarette, wherein during the smoking of the cigarette, the additive acts as an oxidant for the conversion of carbon monoxide to carbon dioxide and/or as a catalyst for the conversion of carbon monoxide to carbon dioxide. Further, the nanoparticle additive can reduce other constituents of mainstream and/or sidestream tobacco smoke, such constituents including aldehydes such as acetaldehyde or acrolein, hydrocarbons such as isoprene and phenolic compounds such as catechol.

"Smoking" of a cigarette means the heating or combustion of the cigarette to form smoke, which can be inhaled. Generally, smoking of a cigarette involves lighting one end of the cigarette and inhaling the cigarette smoke through the mouth end of the cigarette, while the tobacco contained therein undergoes a combustion reaction. However, the cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or 5,322,075, for example.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A cut filler composition comprising tobacco and at least one additive capable of acting as a catalyst for the reduction of at least one constituent from mainstream and/or sidestream tobacco smoke, the at least one constituent being selected from the group consisting of aldehydes, 1,3-butadiene, isoprene, acrolein, acrylonitrile, hydrogen cyanide, o-toluidine, 2-naphtylamine, nitrogen oxide, benzene, N-nitrosonornicotine, phenols, catechol, benz(a)anthracene, benzo(a)pyrene, and mixtures thereof, wherein the additive is in the form of iron oxide nanoparticles, and wherein the iron oxide nanoparticles have an average particle size of about 3 nm.

2. The cut filler composition of claim 1, wherein the additive is capable of acting as a catalyst for the conversion of at least one aldehyde, hydrocarbon and/or phenolic compound to carbon dioxide and water vapor.

3. The cut filler composition of claim 1, wherein the additive further comprises at least one of CuO, $TiO_2$, $CeO_2$, $Ce_2O_3$, $Al_2O_3$, $Y_2O_3$ doped with zirconium, $Mn_2O_3$ doped with palladium, and mixtures thereof.

4. The cut filler composition of claim 1, wherein the additive comprises $Fe_2O_3$, $Fe_3O_4$, FeO or a mixture thereof and optionally Fe.

5. The cut filler composition of claim 1, wherein the additive is capable of converting isoprene and/or catechol to carbon dioxide and water vapor.

6. The cut filler composition of claim 5, wherein the additive is $Fe_2O_3$, $Fe_3O_4$, FeO or a mixture thereof and optionally Fe.

7. The cut filler composition of claim 1, wherein the additive is capable of reducing at least 1,3-butadiene.

8. The cut filler composition of claim 1, wherein the additive is capable of reducing at least acrolein.

9. A cigarette comprising a tobacco rod comprising a cut filler composition having tobacco and at least one additive capable of acting as a catalyst for at least one constituent from mainstream and/or sidestream tobacco smoke, the at least one constituent being selected from the group consisting of aldehydes, 1,3-butadiene, isoprene, acrolein, acrylonitrile, hydrogen cyanide, o-toluidine, 2-naphtylamine, nitrogen oxide, benzene, N-nitrosonornicotine, phenols, catechol, benz(a)anthracene, benzo(a)pyrene, and mixtures thereof, wherein the additive consists essentially of iron oxide nanoparticles.

10. The cigarette of claim 9, wherein the additive is further capable of acting as a catalyst for the conversion of at least one aldehyde, hydrocarbon and/or phenolic compound to carbon dioxide and water vapor.

11. The cigarette of claim 10, wherein the additive is present in an amount effective to convert at least 50% of the nitric oxide to nitrogen.

12. The cigarette of claim 9, wherein the additive comprises $Fe_2O_3$, $Fe_3O_4$, FeO or a mixture thereof and optionally Fe.

13. The cigarette of claim 9, wherein the additive has an average particle size less than about 50 nm.

14. The cigarette of claim 9, wherein the additive has an average particle size less than about 5 nm.

15. The cigarette of claim 9, wherein the cigarette preferably has about 5 mg additive per cigarette to about 100 mg additive per cigarette.

16. The cigarette of claim 9, wherein the additive is capable of converting isoprene and/or catechol to carbon dioxide and water vapor.

17. The cigarette of claim 16, wherein the additive is $Fe_2O_3$, $Fe_3O_4$, FeO or a mixture thereof and optionally Fe.

18. The cigarette of claim 9, wherein the additive is capable of reducing at least 1,3-butadiene.

19. The cigarette of claim 9, wherein the additive is capable of reducing at least acrolein.

20. The cigarette of claim 9, wherein the iron oxide nanoparticles have an average particle size of about 3 nm.

21. A method of treating mainstream smoke produced by a cigarette comprising lighting the cigarette to form smoke and drawing the smoke through the cigarette, wherein the cigarette comprises a tobacco rod comprising a cut filler composition having tobacco and at least one additive capable of reducing at least one constituent from mainstream and/or sidestream tobacco smoke, the at least one constituent being selected from the group consisting of aldehydes, 1,3-butadiene, isoprene, acrolein, acrylonitrile, hydrogen cyanide, o-toluidine, 2-naphtylamine, nitrogen oxide, benzene, N-nitrosonornicotine, phenols, catechol, benz(a)anthracene, benzo(a)pyrene, and mixtures thereof, wherein the additive is in the form of iron oxide nanoparticles, and wherein the iron oxide nanoparticles have an average particle size of about 3 nm.

22. The method of claim 21, wherein the additive further comprises at least one of metal oxides, doped metal oxides, and mixtures thereof.

23. The method of claim 21, wherein the additive comprises $Fe_2O_3$, $Fe_3O_4$, FeO or a mixture thereof and optionally Fe.

24. The method of claim 21, wherein the additive is capable of reducing at least one aldehyde, hydrocarbon and/or phenolic compound to carbon dioxide and water vapor.

25. The method of claim 21, wherein the additive is capable of reducing isoprene and/or catechol to carbon dioxide and water vapor.

26. The method of claim 25, wherein the additive is $Fe_2O_3$, $Fe_3O_4$, FeO or a mixture thereof and optionally Fe.

27. The method of claim 21, wherein the additive is capable of reducing at least 1,3-butadiene.

28. The method of claim 21, wherein the additive is capable of reducing at least acrolein.

29. The method of claim 21, wherein the additive consists essentially of iron oxide nanoparticles.

* * * * *